US008720087B2

(12) United States Patent
Briscoe et al.

(10) Patent No.: US 8,720,087 B2
(45) Date of Patent: May 13, 2014

(54) COUPLING ASSEMBLIES WITH ENHANCED TAKE UP

(75) Inventors: Terry L Briscoe, Portland, OR (US); Kevin S Stangeland, Portland, OR (US)

(73) Assignee: ESCO Corporation, Portland, OR (US)

( * ) Notice: Subject to any disclaimer, the term of this patent is extended or adjusted under 35 U.S.C. 154(b) by 419 days.

(21) Appl. No.: 13/087,589

(22) Filed: Apr. 15, 2011

(65) Prior Publication Data

US 2011/0252672 A1 Oct. 20, 2011

Related U.S. Application Data

(60) Provisional application No. 61/326,155, filed on Apr. 20, 2010.

(51) Int. Cl.
*E02F 9/28* (2006.01)

(52) U.S. Cl.
USPC ..... 37/456

(58) Field of Classification Search
USPC ..... 37/466, 452–457; 172/719, 772, 772.5, 172/701.1–701.3; 403/374.1, 374.3, 374.4, 403/373, 379.4, 33
See application file for complete search history.

(56) References Cited

U.S. PATENT DOCUMENTS

| | | | | |
|---|---|---|---|---|
| 1,021,185 | A | 3/1912 | Foster | |
| 3,032,152 | A * | 5/1962 | Titsler | 403/374.3 |
| 3,572,785 | A | 3/1971 | Larson | |
| 3,722,932 | A | 3/1973 | Dougall | |
| 4,167,355 | A | 9/1979 | Hansson | |
| 4,282,665 | A | 8/1981 | Fletcher | |
| 4,413,432 | A | 11/1983 | Bierwith | |
| 4,433,496 | A * | 2/1984 | Jones et al. | 37/456 |
| 5,438,774 | A * | 8/1995 | Fletcher et al. | 37/456 |
| 5,452,529 | A * | 9/1995 | Neuenfeldt et al. | 37/455 |
| 5,564,206 | A * | 10/1996 | Ruvang | 37/458 |
| 5,964,547 | A | 10/1999 | Brinkley | |
| 6,986,216 | B2 | 1/2006 | Emrich | |
| 7,162,818 | B2 | 1/2007 | Ruvang et al. | |
| 7,171,771 | B2 | 2/2007 | Briscoe | |
| 7,526,886 | B2 * | 5/2009 | McClanahan et al. | 37/457 |
| 7,997,017 | B2 * | 8/2011 | McClanahan et al. | 37/455 |
| 2004/0216334 | A1 | 11/2004 | Emrich et al. | |
| 2004/0244236 | A1 | 12/2004 | Mautino | |
| 2007/0137071 | A1 | 6/2007 | McClanahan et al. | |
| 2007/0137072 | A1 | 6/2007 | Briscoe | |

* cited by examiner

*Primary Examiner* — Robert Pezzuto
(74) *Attorney, Agent, or Firm* — Steven P. Schad

(57) ABSTRACT

Coupling assemblies for releasably holding separable parts together, and in particular for releasably securing a wear member to a support structure in excavating equipment are formed so as to provide increased take up to ensure a tight fit of the wear member on the support structure even if considerable deviation between the parts exists due to wearing, manufacturing variations or the like. The coupling assemblies are suitable for securing points, adapters, shrouds, or other replaceable component to various excavating equipment. The components of the coupling assembly include a wedge and a spool that pivots about a fulcrum when the wedge is driven into assembly for increased take up capabilities. The spool is rotatably engaged around a fulcrum of the support structure and has a bearing portion that bears against and moves the wear member to be secured to thereby take up any gaps between the engaging surfaces of these members. A movable insert may be provided to improve the cooperation between the wedge and the spool to further increase the available take up.

13 Claims, 23 Drawing Sheets

COUPLING ASSEMBLIES WITH ENHANCED TAKE UP

RELATED APPLICATION DATA

This application claims priority benefits based on U.S. Provisional Patent Application No. 61/326,155, filed Apr. 20, 2010 and entitled "Pivoting and Releasable Wedge-Type Coupling Assemblies." This earlier priority application is incorporated herein by reference in its entirety.

FIELD OF THE INVENTION

The present invention pertains to coupling assemblies for releasably securing separable parts together, and especially for securing together components of a wear assembly for excavating equipment and the like. The general field of this invention may be the same as or similar to those described, for example, in U.S. Pat. Nos. 7,174,661 and 7,730,652 owned by BSCO Corporation of Portland, Oreg. These earlier ESCO patents are incorporated herein by reference in their entirety.

BACKGROUND

Excavating equipment typically includes various wear parts to protect underlying products from premature wear. The wear part may simply function as a protector (e.g., a wear cap) or may have additional functions (e.g., an excavating tooth, which functions to break up the ground ahead of the bucket as well as protecting the underlying digging edge). In either case, it is desirable for the wear part to be securely held to the excavating equipment to prevent loss during use, and yet be capable of being removed and replaced when worn. In order to minimize equipment downtime, it is desirable for the worn wear part to be capable of being easily and quickly replaced in the field. Wear parts are usually formed of three (or more) components in an effort to minimize the amount of material that must be replaced on account of wearing. As a result, the wear part generally includes a support structure that is fixed to the excavating equipment, a wear member that mounts to the support structure, and a lock to hold the wear member to the support structure.

As one example, an excavating tooth includes an adapter as the support structure, a tooth point or tip as the wear member, and a lock or retainer to hold the point to the adapter. The adapter is fixed to the front digging edge of an excavating bucket and includes a nose that projects forward to define a mount for the point. The adapter may be a single unitary member or may be composed of a plurality of components assembled together. The point includes a front digging end and a rearwardly opening socket that receives the adapter nose. The lock is inserted into the assembly to releasably hold the point to the adapter.

The lock for an excavating tooth is typically an elongate pin member that is fit into an opening defined cooperatively by both the adapter and the point. The opening may be defined along the side of the adapter nose, as in U.S. Pat. No. 5,469,648, or through the nose, as in U.S. Pat. No. 5,068,986. In either case, the lock is inserted and removed by the use of a hammer. Such hammering of the lock can be an arduous task and impose a risk of harm to the operator.

The lock is usually tightly received in the passage in an effort to prevent ejection of the lock and the concomitant loss of the point during use. The tight fit may be effected by partially unaligned holes in the point and adapter that define the opening for the lock, the inclusion of a rubber member in the opening or in the pin, and/or close dimensioning between the lock and the opening. However, as can be appreciated, an increase in the tightness in which the lock is received in the opening exacerbates the difficulty and risk attendant with hammering the locks into and out of the assemblies.

The lock additionally often lacks the ability to provide substantial tightening of the point onto the adapter. While rubber members have been provided in prior locking systems to provide some tightening of the wear member on the support structure, it has tended to provide only limited benefit as the rubber lacks the strength needed to ensure a tight fit when the teeth are under load during use. Most locks also fail to provide any ability to be retightened as the parts become worn. As a result, many locks used in teeth are susceptible to being lost as the parts wear and the tightness decreases. Prior locks that provide take up or the ability to be retightened tend to rely upon threads or wedges, which commonly suffer from removal difficulties and/or safety issues.

Shortcomings in the locking arrangements are not limited strictly to the mounting of points on adapters. In another example, an adapter is a wear member that is fit onto a lip of an excavating bucket, which defines the support structure for the adapter. While the point experiences the most wear in the system, the adapter will also wear and in time need to be replaced. It is common for adapters to be mechanically attached to a bucket lip so as to permit the use of harder steel and to accommodate replacement in the field. One common approach is to use a Whisler style adapter, such as disclosed in U.S. Pat. No. 3,121,289 (see FIG. 8). In a traditional Whisler system, the adapter is formed with bifurcated legs that straddle the bucket lip. The adapter legs and the bucket lip are formed with openings that are aligned for receiving the lock. The lock in this environment comprises a generally C-shaped spool and a wedge. The arms of the spool overlie ramps on the rear end of the adapter legs. The ramps on the legs and the inner surfaces of the arms are each inclined rearward and away from the lip. The wedge is then hammered into the aligned openings to force the spool rearward. This rearward movement of the spool causes the arms to tightly pinch the adapter legs against the lip to prevent movement or release of the adapter during use.

However, the hammering of the wedge into and out of the openings in a Whisler-style lock tends to be difficult and potentially hazardous. Removal can be particularly difficult as the bucket must generally be turned up to provide access for driving the wedges out of the assembly. In this orientation of the bucket the worker must access the opening from beneath the bucket and drive the wedge upward with a large hammer. The risk is particularly evident in connection with large buckets. Also, because wedges can eject during service, it is common for the wedges to be tack-welded to its accompanying spool, which eliminates any retightening and makes wedge removal more difficult.

In many assemblies, other factors can further increase the difficulty of removing and inserting the lock when replacement of the wear member is needed. For example, the closeness of adjacent components, such as in laterally inserted locks (see, e.g., U.S. Pat. No. 4,326,348), can create difficulties in hammering the lock into and out of the assembly. Fines can also become impacted in the openings receiving the locks making access to and removal of the locks difficult.

There have been some efforts to produce non-hammered locks for use in excavating equipment. For instance, U.S. Pat. Nos. 5,784,813 and 5,868,518 disclose screw driven wedge-type locks for securing points to adapters, and U.S. Pat. Nos. 4,433,496 and 5,964,547 disclose screw-driven wedges for securing adapters to buckets. While these devices eliminate the need for hammering, they each require a number of parts, thus, increasing the complexity and cost of the locks. The ingress of fines can also make removal difficult as the fines increase friction and interfere with the threaded connections. Moreover, with the use of standard threads, the fines can build up and become "cemented" around the threads to make turning of the bolt and release of the parts extremely difficult as can corrosion and damage to the threads.

U.S. Pat. Nos. 6,986,216, 7,174,661 and 7,730,652 disclose locking arrangements for wear assemblies that rely upon a threaded wedge that engages a thread formation on the spool or wear member, and is rotated to drive the wedge into and out of the opening. These systems require minimal components, eliminate hammering, and alleviate the removal problems associated with prior systems. However, they lack the ability to provide substantial take up to ensure a tight fit with the lip or other supporting structure, or effective retightening after wear occurs.

Typically, in a mining operation, a major earthmoving machine like a large cable shovel or dragline machine may have as many as three buckets dedicated to the machine. These buckets will include one bucket that is actively in use on the machine, one bucket that has been taken off the machine and is in the rebuild shop (e.g., to have various wear members removed and replaced with new wear members and to rebuild the lip for the tooth base and shroud fit areas), and one "ready line" bucket. The ready line bucket is a bucket that is new or has been through the re-build process and is ready to go back to work. The ready line bucket is needed because a bucket rebuild can take months to complete. It can be used on a scheduled maintenance cycle or, as can happen, when a major failure occurs with the bucket on the machine. Because the rebuild process takes so long, a mine cannot afford to not have a bucket available to put on a machine in case of emergency. The downtime and associated economic loss would be too great.

While larger mining operations (e.g., operations involving multiple cable shovels and/or dragline machines) may not have three buckets dedicated to each machine, the operation will still typically have a sufficient number of ready line buckets available, if needed, to prevent excessive downtime (i.e., to avoid having a machine inoperable while waiting for a bucket rebuild job to be completed). The need for numerous ready line buckets represents a significant cost for the mining operation.

Because the lip rebuild tends to be the most time consuming part of the bucket rebuild process, reducing the number of rebuilds by lengthening the time between rebuilds would be a huge savings. Such a reduction in the number or frequency of rebuilds to the lip or other parts of the bucket would save the end user the money and time needed to perform these rebuilds as well as avoid the downtime associated with having the excavating bucket detached from the machine or unavailable for use in moving material. Reducing the number of lip rebuilds could constitute a huge savings in terms of less inventory of replacement buckets, fewer welders required to do these rebuilds, and a more forgiving system that is easier to operate and can be changed when it is more convenient for the operation.

Since the bucket lip takes substantial abuse and is under considerable load during use, it needs to retain its strength and integrity to avoid failure. While welding on a lip rebuilds the leading edge of the lip to its original form, it also poses a risk to the lip if not done correctly. The lip must be preheated and welding procedures must be followed very carefully in order to avoid developing cracks. A cracked lip will necessitate the bucket being removed from the machine and repaired. However, if one does not need to weld repair the lip as often, then one possible failure mode is reduced or limited, thus minimizing the chances for a lip crack or failure.

One factor that may influence the need to repair or rebuild the lip on a bucket relates to whether the system for coupling the wear member to the lip is capable of securely engaging the parts together. The coupling system must be able to move the wear member a sufficient distance with respect to the lip to seat the wear member onto the lip. This amount of movement is referred to as "take up" (e.g., the coupling system must move the wear member a sufficient distance with respect to the lip to "take up" any gap or distance between the wear member and the lip). If a coupling system can only move a wear member a small distance with respect to the lip, the coupling system has a small take up capability, and in such systems, the mine operator may be forced to rebuild the lips more frequently (to assure that the coupling system will have sufficient take up to move the wear member and securely hold it against the lip). For coupling systems with a small amount of available take up, the lip rebuild also must be relatively precise to assure that the coupling system will be able to move the wear member and hold it onto the lip. Systems with wear members that are not tightly held to the supporting structure will tend to suffer more wear and tend to be more susceptible to wear member loss. While premature wearing of the lip may be of primary concern, premature wearing of other support structures, such as adapters, can also increase downtime and costs due to more frequent replacement.

Accordingly, improvements in releasable coupling systems for securing wear members to the digging edge of a bucket would be welcome in the mining and construction industries. There remains a need for coupling systems that are easy and safe to install and remove, are reliable in use, enable substantial take up, allow longer time periods between bucket rebuilds, permit a wider range of dimensional variation in the manufacturing processes for the various parts, and lead to less machine downtime. Such improvements would result in reduced costs by decreasing the need for ready line buckets and the expense associated with rebuilding the digging edge of the buckets.

SUMMARY OF THE INVENTION

This invention relates to improved assemblies in which separable parts are releasably held together in a secure, easy, and reliable manner. The present invention is particularly useful for securing wear members to support structures in conjunction with excavating equipment and excavating operations. Coupling assemblies of the present invention are easy to use, are reusable, are securely held in the wear assembly, and operate to effectively tighten the wear member onto the support structure.

One aspect of the invention pertains to a lock for use in securing a wear member to a support structure that includes a wedge and a spool wherein the spool pivots or rotates about a fulcrum on the support structure to tighten and securely hold the wear member to the support structure as the wedge is driven into the assembly. The pivoting of the spool, as opposed to the rearward translation of spools in the prior art, provides increased take up to ensure a tight fit even after considerable wear of the underlying support structure. The invention permits effective retightening of the wear member and allows the use of larger manufacturing tolerances between engaged parts. The increased take up allows the lip leading edge, as well as all other components, to have a longer life before it needs to be rebuilt, which can lead to lower costs on account of reduced bucket inventory, labor costs, and/or equipment downtime associated economic loss. Moreover, the improved take up is preferably accomplished in a hammerless lock for enhanced safety.

Additional aspects of this invention relate to coupling assemblies in which a large amount of take up is available in relatively compact and internally contained locks (i.e., the locks may be completely or substantially internally contained within openings provided in the components to be coupled together). The large amount of available take up also aids in the assembly and disassembly of the coupling because the various parts can be relatively loosely fit together until tightening is completed and can be made relatively loose when the wedge is loosened (so that disassembly is easy and quick). Additionally, the compactness of the locks allows the majority or all of the lock to be contained within openings provided in the wear member and/or the support structure, thereby protecting the lock and its parts from material flow (e.g., protecting the spool and wedge against damage due to contact with rocks or other materials during use).

In one embodiment of the invention, a lock for securing a wear member to a support structure includes a wedge and a spool. The spool is formed with an axially convex engagement surface in which to engage the wedge. This convex engagement surface causes the spool to pivot or rotate about a fulcrum on the support structure for enhanced take up.

In another aspect of the invention, a lock for securing a wear member to a support structure includes a wedge, a spool and an insert that all move relative to each other to effect pivoting or rotation of the spool about a fulcrum on the support structure for increased take up. The use of a movable insert increases the amount take up, in some cases, up to three to four times what is available in prior wedge and spool systems.

In one embodiment of the invention, the insert is movably secured to the spool to engage the wedge. As the wedge is driven into and out of the assembly, the engagement of the insert with both the wedge and the spool causes the spool to rotate to tighten the fit of the wear member on the support structure.

In another embodiment of the invention, the insert and the spool engage the wedge on opposite sides and are secured to the support structure such that the insert and spool each pivot or rotate as the wedge is driven into and out the assembly.

Another aspect of this invention relates to coupling assemblies that provide elastic tightening between the wedge and the insert. This feature helps maintain secure contact between the insert and the wedge during use, secures the insert to the spool without the wedge (such as during shipping, installation and removal), and provides a limited tightening benefit by way of elastic take up.

In another aspect of the invention, a part of the wear member overlies the support structure and includes a hole. The hole has a first portion that extends entirely through the overlying part in a first direction for receipt of a wedge and spool locking assembly, and a second portion laterally outside of the first portion that extends only partially through the overlying part on account of the presence of a ledge. A bearing portion of the spool extends over the ledge to prevent movement of the wear member away from the support structure, to hold the spool in place without the wedge in the hole, and to apply no forces to urge the spool in directions transverse to the first direction during use.

In one embodiment of the invention, the ledge extends entirely across a rear end of the hole. In another embodiment, the ledge is provided only laterally of the first portion of the hole. In either case, the second portion preferably includes a rear wall against which the spool pushes to tighten the wear member on the support structure. The second portion of the hole also preferably includes a front wall to retain the spool in a rearward end of the first portion of the hole for easy insertion of the wedge.

Other aspects, advantages, and features of the invention will be described in more detail below and will be recognizable from the following detailed description of example structures in accordance with this invention.

BRIEF DESCRIPTION OF THE DRAWINGS

The present invention is illustrated by way of example and not limited in the accompanying figures, in which like reference numerals indicate the same or similar elements throughout, and in which.

The reader is advised that the various parts shown in these drawings are not necessarily drawn to scale.

DETAILED DESCRIPTION

The following description and the accompanying figures disclose example features of coupling assemblies for releasably holding separable parts together in accordance with examples of the present invention. While the invention has broader applications, it is particularly useful in releasably securing wear members to support structures in excavating equipment and excavating operations. The wear members may be, for example, points, adapters, shrouds, or other replaceable components. Examples of machinery on which locking mechanisms in accordance with this invention may be used include, but are not limited to, shovel dippers, dragline buckets, front end loaders, hydraulic shovels, dredge cutters, and LHD buckets.

Figure 1A:
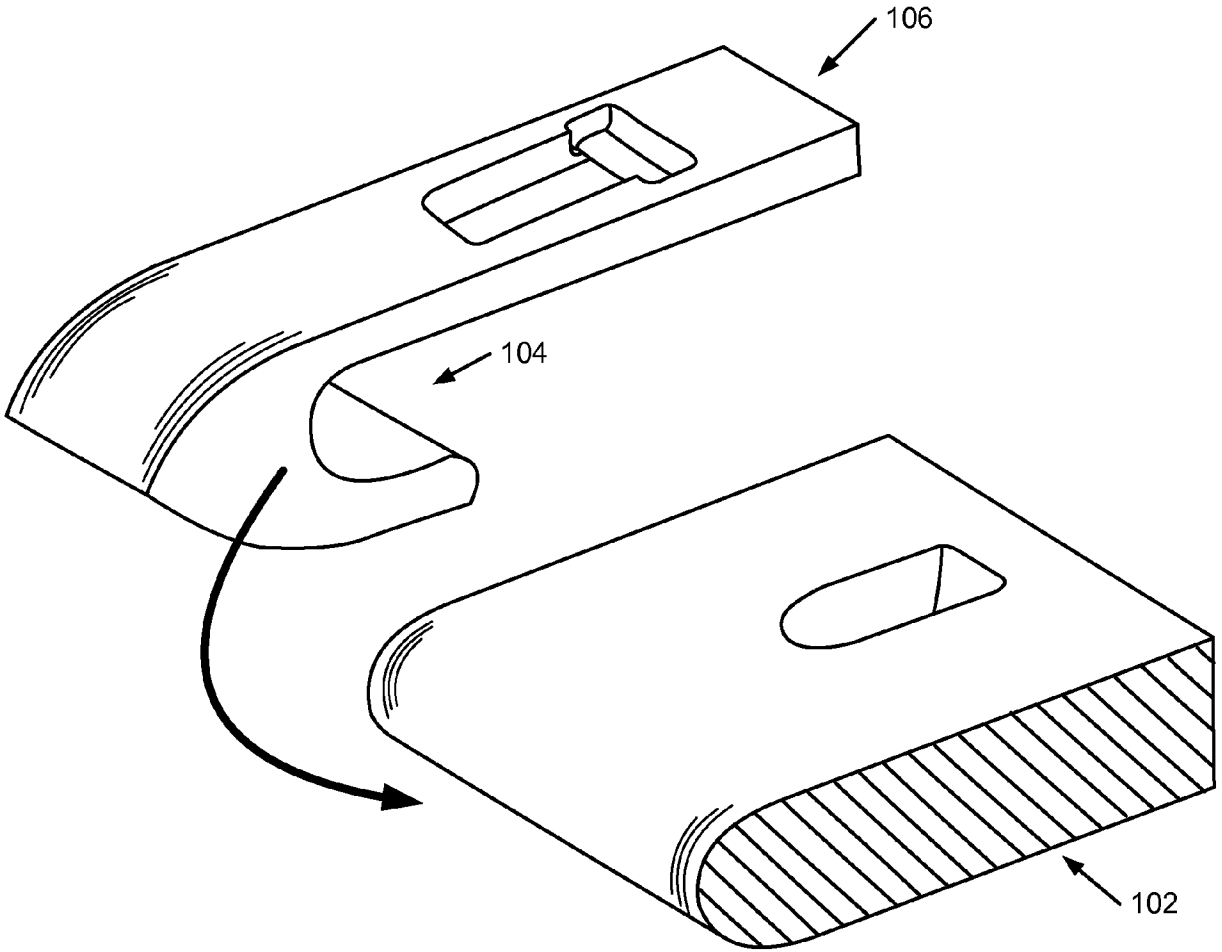
FIG. 1A is an exploded, perspective view of a general example of a wear member and a lip that may be held together using releasable coupling assemblies in accordance with this invention.
Figure 1B:
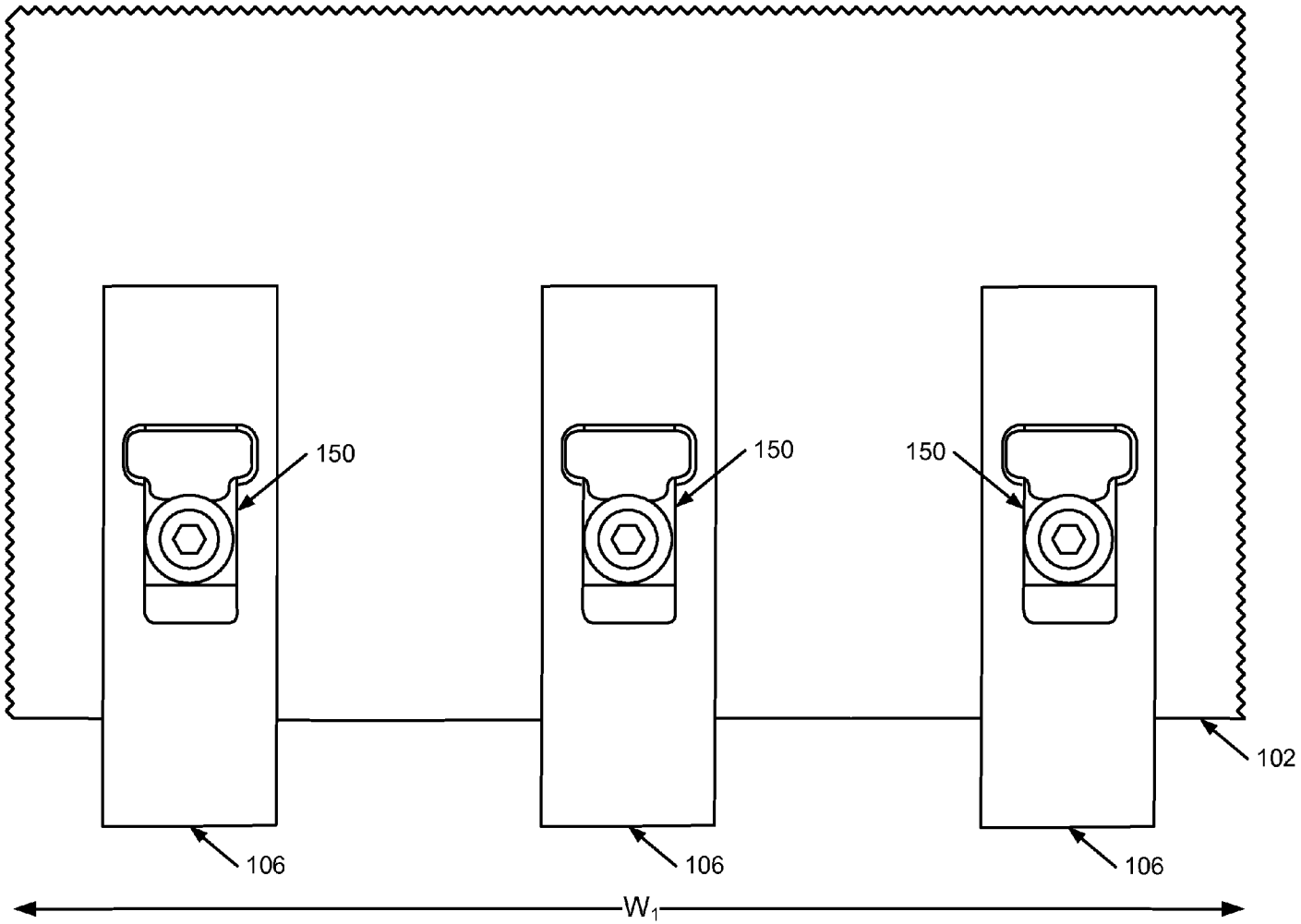
FIG. 1B is a top view of part of a lip with wear members attached to it in accordance with the present invention.

FIGS. 1A and 1B illustrate an example of a wear member and a lip that may be held together using releasable coupling assemblies in accordance with this invention. The lip 102 is part of a bucket (not shown) for any of a variety of excavating machines. The wear member 106 is shown as a shroud that fits onto lip 102, and is secured to the lip by a lock 150. Shroud 106 includes a hole or opening 110 that generally aligns with a hole 152 in the lip for receipt of the lock 150 that holds the shroud to the lip (FIGS. 2A-3B). This example of mounting a shroud (as the wear member) on a lip (as the support structure) is used as a convenience to illustrate the different aspects of the invention. However, aspects of the invention can be used to secure other components together such as other wear members to other support structures. As examples only, aspects of the present invention may be used to secure adapters to lips or points to adapters. Further, these various other parts may have other constructions and/or shapes without departing from this invention.

As shown in FIG. 1B, a lip 102 may include several wear members 106 distributed along its width direction $W_1$ (three wear members 106 are shown in FIG. 1B). In this example, the wear members are shown as spaced apart shrouds 106. Ordinarily, teeth (not shown) would be attached to the lip between the shrouds. Alternatively, the shrouds may be wider than shown to eliminate the gaps between them if an application did not require any teeth on the lip. Each wear member 106 is secured to the lip by a lock 150.

Figure 3A:
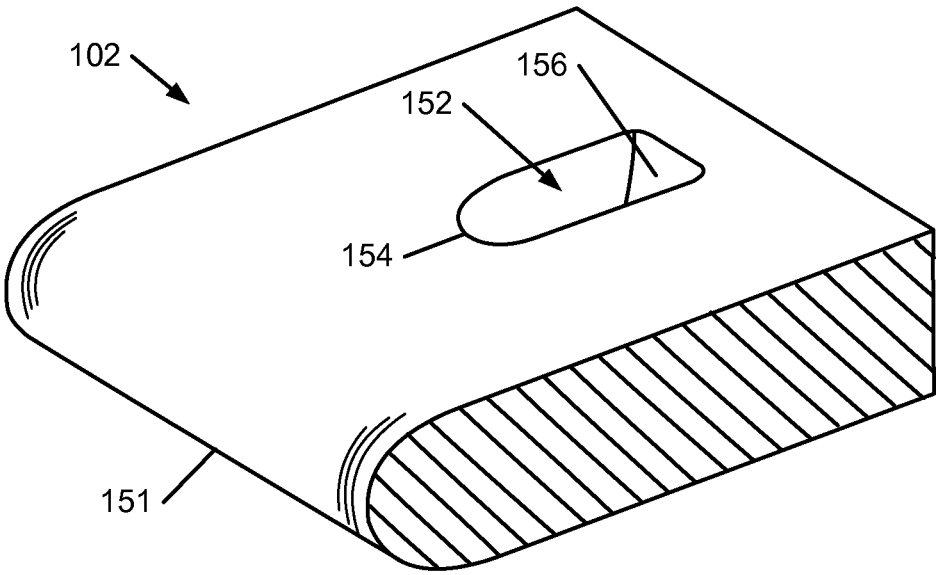
FIG. 3A is a partial perspective view of a conventional lip for an excavating bucket.
Figure 3B:
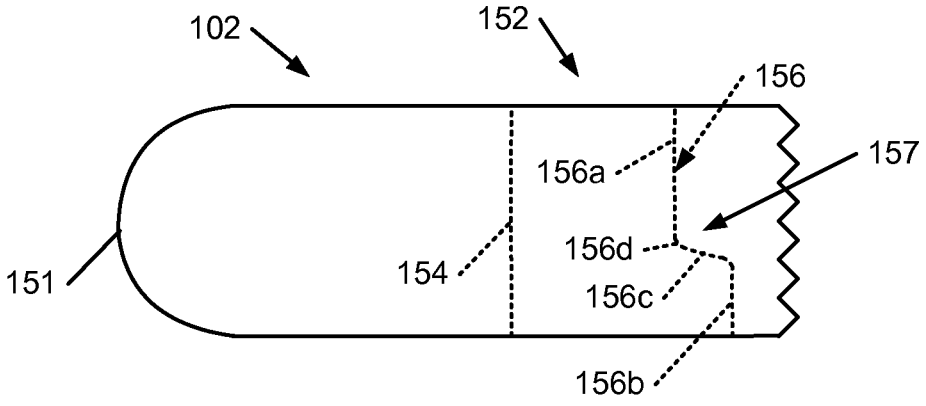
FIG. 3B is a side view of the conventional lip.

FIGS. 3A and 3B illustrate a conventional lip 102 with a rounded front end 151. Nevertheless, other lips having different constructions and other front ends could be used. The lip 102 includes a hole or opening 152 into which a lock 150 in accordance with the invention is received. The opening 152 includes a front wall 154 and a rear wall 156. The rear wall 156 includes two substantially parallel end segments 156*a* and 156*b* (shown as having a vertical orientation), and an inclined medial segment 156*c* connecting the end segments 156*a* and 156*b*. The medial segment 156*c* preferably meets end segment 156*a* at a rounded corner or edge to form a fulcrum or mounting corner 157 for the lock 150. Other interior wall shapes and/or constructions (e.g., for walls 154 and 156) are possible without departing from this invention. For example, the medial segment 156*c* could be eliminated such that rear wall 156 had a generally straight vertical orientation. In this arrangement, the intersection of rear wall 156 and the bottom surface of the lip could form the fulcrum or mounting corner for the lock. Additionally, other structures could be provided as a fulcrum for the lock so long as the structure enabled the spool to engage and pivot in order to tighten and hold the wear member to the support structure.

Figure 2A:
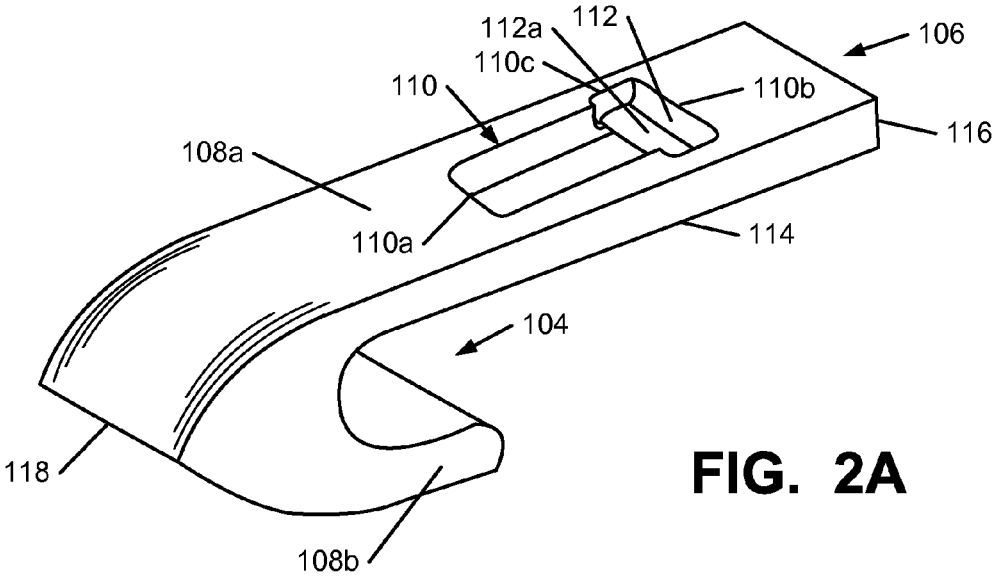
FIG. 2A is a perspective view of a wear member in accordance with the present invention.
Figure 2B:
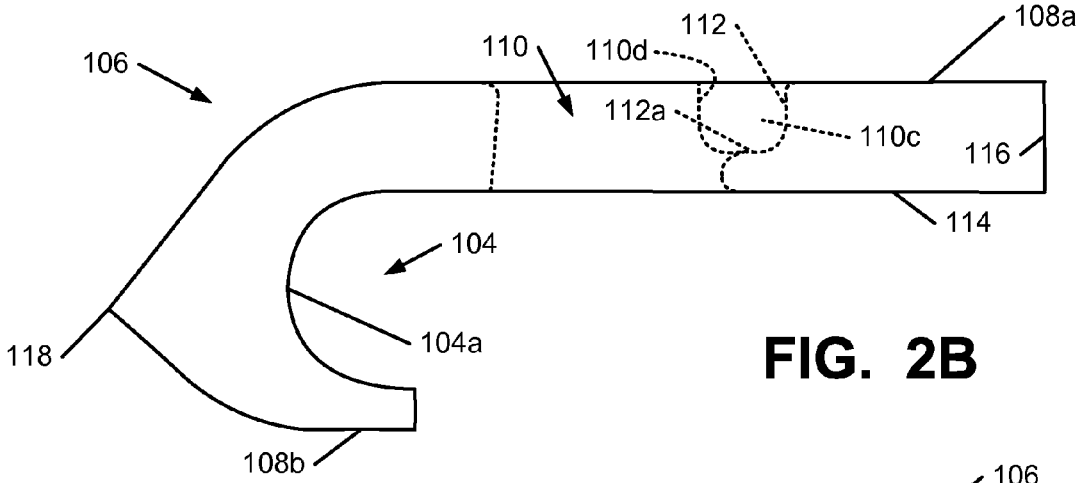
FIG. 2B is a side view of the wear member.
Figure 2C:
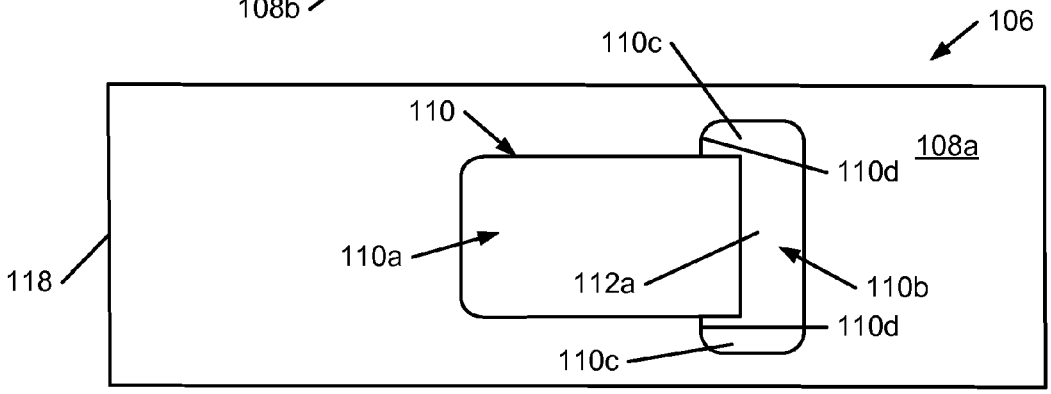
FIG. 2C is a top view of the wear member.

FIGS. 2A through 2C show an example shroud 106 that may be fit onto a lip in accordance with the invention. Shroud 106 includes a pair of rearwardly extending legs 108*a*, 108*b* that define a gap 104 that receives the lip so the legs fit over and straddle the front end 151 of lip 102. The gap 104 in this example has a rounded front bearing surface 104*a* to complement and abut the rounded front end 151 of the lip, but it could have other shapes especially if made for other lip constructions. For example, the gap could be formed to match a lip having a sharp vertical front or beveled front edge. A wear assembly in accordance with the invention is usable with either a plate lip or a cast lip. The upper leg 108*a* includes a hole 110 through which a lock in accordance with this invention may be engaged and accessed.

The shroud opening 110 preferably includes a narrower first portion 110*a* and a wider second portion 110*b*. As illustrated, the first portion 110*a* of the opening 110 defines the front of the opening and extends completely through upper leg 108*a* of the shroud 106, whereas the rear portion 110*b* extends only partially through the upper leg 108*a*. In one embodiment, ledge 112*a* extends across the entire width of wider rear portion 110*b*. In another embodiment (not shown), ledge 112*a* may only be provided in side portions 110*c* with the remainder of the hole being the first portion extending all the way through the leg. In either embodiment, ledge 112*a* extends into the opening 110 and provides a surface over which a portion of the lock extends to help prevent the shroud 106 from pulling upward and away from the lip when put under certain loads during digging. In the present invention, the lower leg 108*b* is preferably shortened to reduce the material needed to make the part, the cost of manufacture, and the weight of the wear member on the machine.

A lock 150 in accordance with the invention includes a threaded wedge 350 such as disclosed in U.S. Pat. No. 7,174,661, and a spool 200. The spool and wedge cooperate with each other, and with the wear member and the support structure, so that the spool rotates as the wedge is driven into the assembly to provide substantial take up to pull the wear member tight against the support structure. While a threaded wedge and spool are preferred to avoid the use of a hammer, a hammered wedge and spool could be used in the invention.

In the embodiment illustrated in FIGS. 4-8, the spool 200 engages both the wear member 106 and the support structure 102. Spool 200 preferably includes a central stem portion 201 and a pair of bearing portions 202, 204, which in this embodiment are defined as upper and lower arms at opposite ends of stem 201. While bearing portions 202, 204 preferably extend rearward to define a C-shaped spool, they could extend laterally (such as disclosed in U.S. Pat. No. 7,730,652) or the spool could have other kinds of bearing portions (i.e., besides extending arms) for engaging the wear member and support structure.

Figure 4:
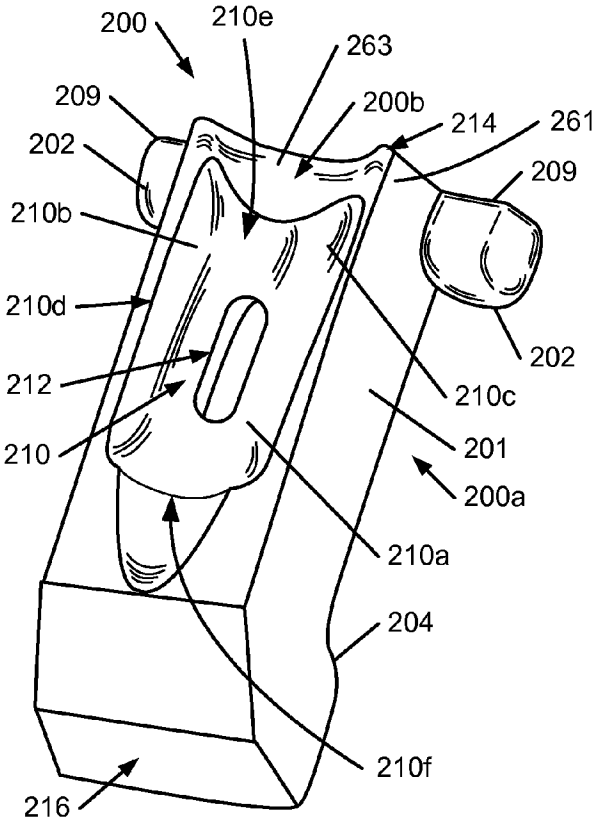
FIG. 4 is a perspective view of a spool for use in a lock in accordance with the invention.

As seen in FIG. 4, the rear side 200*a* of the spool 200 includes a first or upper bearing portion 202 that overlies ledge 112*a* and engages the rear wall 112 of the opening 110 in the shroud 106. The contact of bearing portion 202 against rear wall 112 facilitates the tightening of the wear member 106 on the support structure 102 when the spool rotates. The bearing portion 202 overlies ledge 112*c* to prevent the upper leg 108*a* from being pulled upward and away from lip 102 when downwardly directed loads are applied to the front end 118 of the shroud during digging. The bearing portion 202 does not apply a constant inward pinching force on ledge 112*a* (or otherwise on shroud 106) to hold the shroud tightly against the lip as in a traditional Whisler locking arrangement. This change in the function of the spool greatly reduces the stress on the spool, which can lead to the use of a small spool and less risk of spool failure.

Upper bearing portion 202 includes laterally extending side portions 209. Side portions 209 extend laterally outward of the stem portion 201 of the spool 200 and laterally outward of the narrower portion 110*a* of opening 110 for receipt into side portions 110*c* of the wider rear portion 110*b* of the opening 110. These laterally extending side portions 209 are preferably confined by rear wall 112, ledge 112*a* and a front wall 110*d* to hold the spool in place prior to insertion of the wedge during installation, and after removal of the wedge during replacement of the wear member. More specifically, the engagement of the side portions 209 with ledge 112*c* and front wall 110*d* prevent the wedge from slipping through the hole 152 in lip 102 to ease installation. This not only makes installation easier and quicker, it can be a considerable advantage when installation occurs at night or during inclement weather. Finding a spool that has dropped through the lip can be difficult, and it can also put a worker in a hazardous position under the bucket. These same advantages are also provided during removal, i.e., side portions 209 retain spool 200 to the shroud 106 after the wedge as been taken out of the assembly. The front wall 110*d* holds the spool in a rearward position to provide a preset space to receive the leading end of the wedge during installation. Other configurations besides side portions 209 could be provided to achieve the same purpose, but this construction is preferred as it is an efficient structure relative to the overall construction, it does not impair the strength or operation of the shroud or other components of the wear assembly, it is reliable, and it is cost effective to manufacture. Further, as noted above, ledge 112*c* could be confined solely to side portions 110*c* such that only side portions 209 perform the functions of pushing on rear wall 112 and/or preventing movement of leg 108*a* away from the lip 102.

Rear side 200*a* of the spool 200 further includes a second or lower bearing portion 204 that engages corner 156*d* in the opening 152 of the lip 102. The connection of bearing portion 204 to stem portion 201 may include a rounded corner in similar size and shape to the rounded corner edge 156*d* of the lip wall 156. In this example structure, the spool 200 generally forms a C-shaped arrangement that fits into the openings 110 and 152 of the shroud 106 and lip 102. Corner 156*d* defines a fulcrum 157 for the spool to facilitate pivoting or rotation of the spool for increased take up. As noted above, other constructions could be used as the anchor for the spool.

In a preferred construction, lock 150 also includes an insert 250 that is movably secured to the spool. The insert defines the connection between the wedge and the spool in such a way that the spool pivots or rotates about fulcrum 157 as the wedge is driven into and out of the assembly so as to provide the wear member with substantial take up.

The opposite front side 200*b* of the spool 200 includes the hollowed out portion or recess 210 into which the insert 250 is received. The recess 210 in this example is defined by (a) a generally arched inner surface 210*a*, (b) two opposing side walls 210*b* and 210*c*, and (c) a generally open space 210*d* between the side walls 210*b* and 210*c* opposite the inner surface 210*a*. Smoothly rounded edges and corners are preferably provided between the various surfaces and walls of the recess. Inner surface 210*a* is preferably arcuate in shape along the length of stem 201 (i.e., in a vertical direction as shown in FIG. 6C). This arcuate surface defines a path along which the insert 250 travels relative to the spool when the wedge is driven into and out of the assembly. When the wedge is driven into the wear assembly, the threads on the wedge 350 engage the threads on the insert 250. Rotating the wedge in one direction causes the wedge to be driven downward and farther into the assembly. The relative translation of the wedge along the insert causes the insert to move rearward as the wider portion of the wedge is received into the opening. This movement of the insert causes the spool 200 to rotate about the fulcrum 157. This movement of the spool results in the insert moving along the arcuate inner surface 210*a* of recess 210, though the insert itself may move vertically only a little with respect to the lip 102.

The side walls 210*b* and 210*c* of recess 210 are provided to hold the insert to the spool 200 and, in cooperation with inner surface 210*a*, guide the insert along its prescribed path of movement relative to the spool. In one embodiment, side walls 210*b*, 210*c* extend somewhat inward toward one another as they extend forward and away from the inner surface 210*a*. For example, the side walls may converge at an angle within a range of 15° to 45°, and in one preferred example at an angle of about 30°, though other tapers are possible. This forward tapering of the side walls results in a front space 210*d* that is narrower than the width of the insert at its widest point to prevent loss of the insert through the front of the recess. The side walls 210*b* and 210*c* also preferably taper inward toward one another in a direction from a top end 214 to a bottom end 216 of the spool 200. For example, the side walls may taper along the length of stem 201 within a range of 2° to 15°, and preferably at an angle of about 7°. Preferably, this taper of the side walls should be roughly equal to the taper of the wedge simply for ease of use and space requirements but is not required to be, though other tapers are possible. This downward tapering results in side walls 210*b*, 210*c* defining a space that is narrower than the width of the insert 250 at its wider top end to prevent loss of the insert out the bottom of recess 210. These various tapers define a path to guide the insert 250 along its desired course without binding and without loss of the insert from the spool 200. The tapers also function to retain the insert in the spool when the wedge is not engaged, such as during shipping, installation and removal of the lock. The top end of recess 210 is open and sufficiently large to define an inlet 210*e* through which the insert is fit into the recess. While the insert is preferably slid into recess 210 during initial manufacture of the lock, it could be inserted by the end user prior to installation into the wear assembly. Other arrangements (i.e., beside the tapering side walls) could be used including, for example, the use of a key and keyway, rim portions on the outer edges of the walls defining the hollowed out portion to overlie the insert to retain and guide the insert as desired.

As noted above, the insert 250 is capable of moving within recess 210 (i.e., relative to the spool 200) in response to downward movement of the wedge. The recess forms a guide for directing the insert along a prescribed path. As the wedge is driven into the assembly to tighten the connection, the spool is rotated or pivoted about fulcrum 157 such that upper bearing portion 202 pushes against rear wall 112 to push the shroud 106 rearwardly and tightly against the lip 102, i.e., so that bearing surface 104*a* on the shroud is tightly abutted against the front end 151 of lip 102.

Figure 6B:
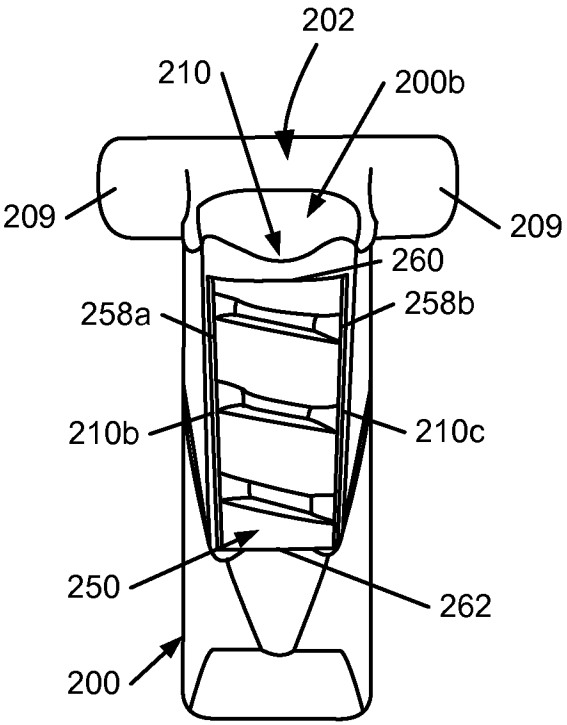
FIG. 6B is a front view of the spool assembly.
Figure 6A:
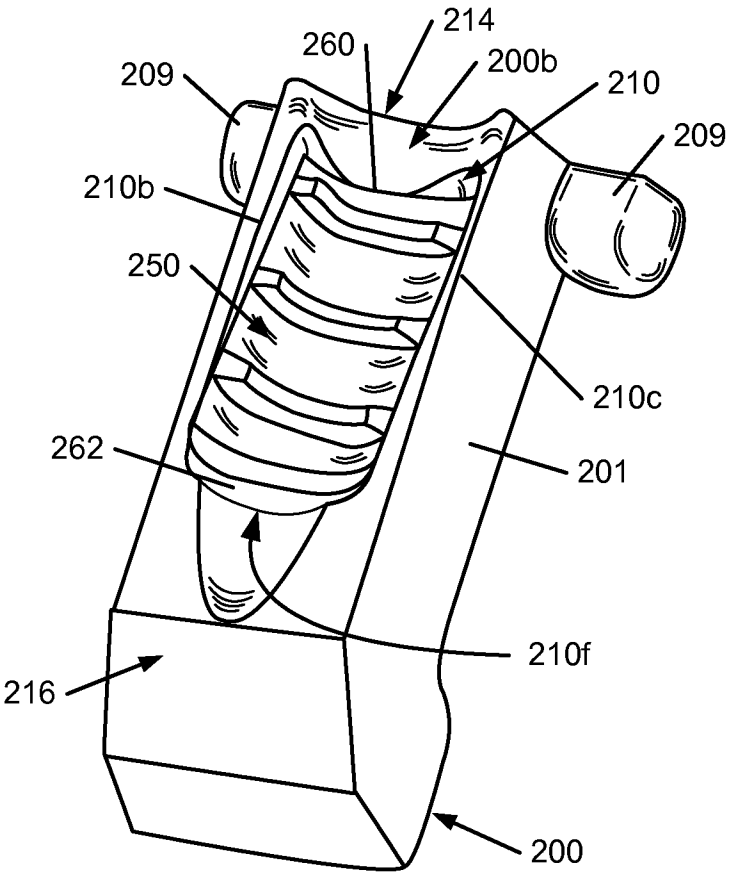
FIG. 6A is a perspective view of the insert secured to the spool to define a spool assembly for use in a lock in accordance with the invention.
Figure 6D:
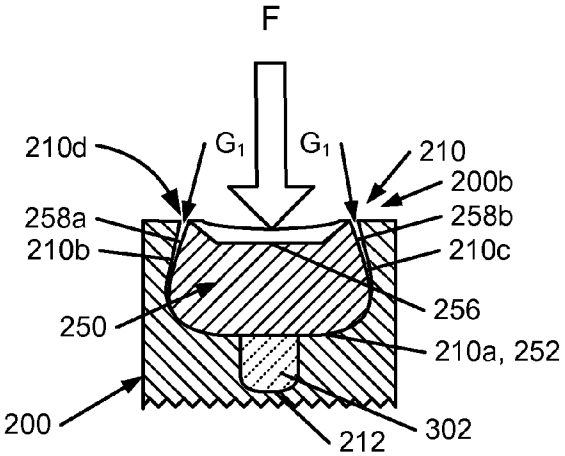
FIGS. 6D and 6E are cross sectional views of the spool assembly taken along line 6-6 in FIG. 6C.
Figure 6E:
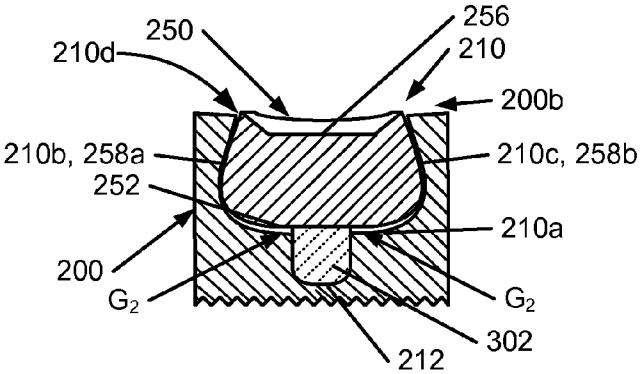
Figure 6C:
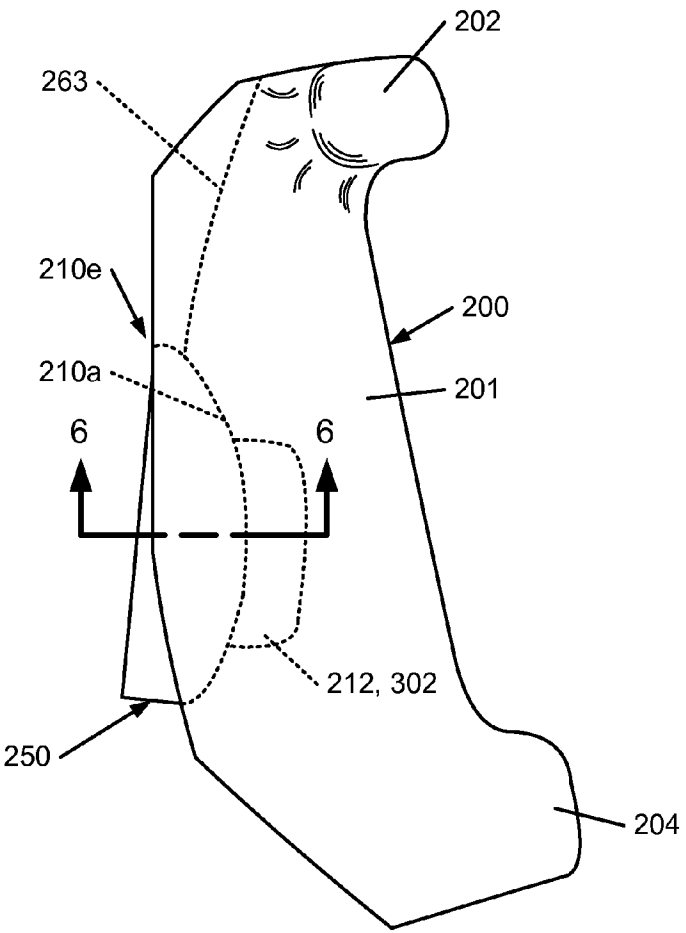
FIG. 6C is a side view of the spool assembly.

Recess 210 preferably includes a cavity 212, which as illustrated is an elongate vertical slot in inner surface 210*a*, to provide a space for receiving and mounting a resilient member 302 (FIGS. 6D and 6E). Nevertheless, cavity 212 may be any desired size or shape, or provided in another part of the recess, or eliminated altogether and resilient member secured in another way without departing from this invention. The resilient member 302 may be made of any desired material, such as rubber (e.g., 65 durometer Shore D rubber), other elastomers or polymeric materials (e.g., closed cell foam 80 durometer polyurethane with a 2% expand cell), or various spring assemblies. The resilient member provides a constant force that urges insert 250 forward and, when in use, into continual contact with wedge 350. This contact provides a sure engagement of the threads on insert 250 and wedge 350 when driving the wedge into and out of the assembly, and lowers the risk of wedge ejection during digging. The tightening provided by resilient member 302 also functions to hold the insert 250 in the recess 210 during shipping and storage of the spool as well as during installation and removal of the lock 150. The resilient member 302 also performs the function of providing some elastic take up to the spool and hence the shroud to maintain a tight fit between the shroud and the support member. This "tight fit" is not intended to or capable of overcoming the rigors of the machine digging but it does tend to take out the gap between the shroud and the lip so that when an impact load is applied to the shroud it is already in contact with the lip and therefore less damage is done to both the lip and shroud interface.

Figure 5B:
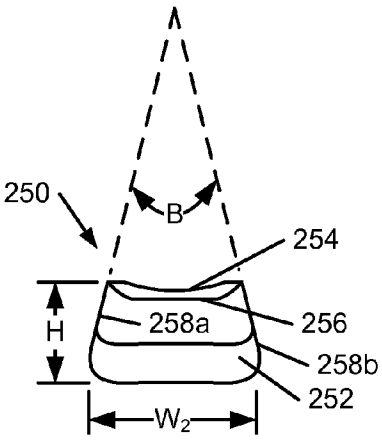
FIG. 5B is a top view of the insert.
Figure 5C:
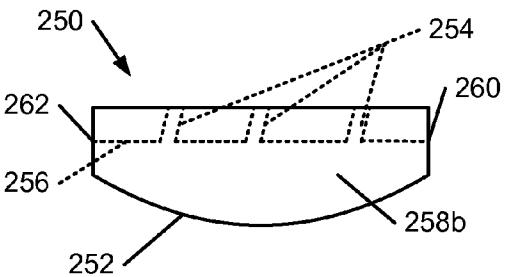
FIG. 5C is a side view of the insert.
Figure 5A:
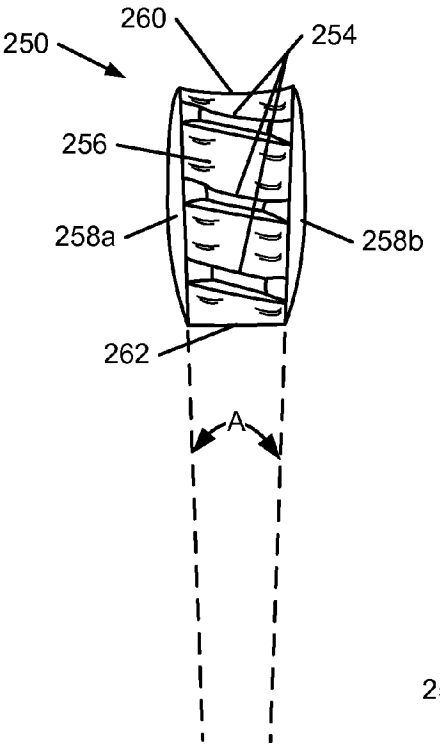
FIG. 5A is a front view of an insert for use in a lock in accordance with the invention.

Insert 250 is received within recess 210 of the spool 200 in this example coupling assembly (FIGS. 5A-5C). As shown in FIG. 5C, the rear inner surface 252 of the insert 250 is curved from the top end 260 of the insert to the bottom end 262 of the insert. This curve of inner surface 252 preferably matches the curved shape of the inner surface 210*a* in recess 210, but it could be different so long as the insert 250 still moves relative to the spool along the prescribed path. However, in general, the better these two surfaces match the lower the contact pressure, the less point loading is applied which results in lower stress in both members. A front outer surface 256 of the insert 250 includes exposed threads 254 (also called "thread segments" herein) for engaging the wedge. This front surface 256 may be shaped as a continuous lateral curve to receive the wedge or, as shown in FIG. 5B, may have somewhat of a faceted shape (e.g., with flat sides joined by rounded corners) when using a wedge having facets. While the illustrated insert 250 includes three thread segments 254 which each extend about ⅕ of the way around a full circumference, any desired number of thread segments 254 and/or any desired amount of circumferential extent may be provided without departing from this invention.

The front surface 256 of the insert 250 may be tapered from its top end 260 to its bottom end 262 as shown in FIG. 5A. This taper preferably allows for easier insertion of the insert through inlet 210*e* and into recess 210, and for easier passage of the bottom of the insert through open space 210*d* at the bottom 210*f* of recess 210 when fit into the recess, i.e., when ready to first engage the wedge when it is inserted, but without permitting the insert to pass out of the recess. The side walls 258*a* and 258*b* of the insert 250 also may be tapered over the insert's depth H (i.e., from front surface 256 to rear surface 252 as shown in FIG. 5B), e.g., to generally match the taper of the side walls 210*b* and 210*c* in recess 210 (i.e., from the open front surface to the rear surface 210*a* of the hollowed out portion 210), though other tapers could be used. In this example, insert 250, the side walls 258*a* and 258*b* are tapered at an angle B in FIG. 5B, wherein the angle B is within a range of 15° to 45°, and in one embodiment at an angle of about 30°, though other tapers and other non-tapered constructions are possible.

FIGS. 6A through 6E illustrate the spool 200 with the insert 250 received within recess 210 of the spool 200. To engage the spool 200 and insert 250 together, the lower end 262 of the insert 250 slides through inlet 210*e* and into the top portion of recess 210. Because the upper end 260 of the insert 250 is wider than its lower end 262, because the side walls 210*b* and 210*c* of recess 210 taper inward from top to bottom, and because the upper end 260 of the insert 250 is wider than the separation between the side walls 210*b* and 210*c* at the bottom 210*f* of the recess 210, the insert 250 can slide upward and downward in the hollowed out portion 210, along inner surface 210*a*, but it cannot slide all the way out the bottom end of the hollowed out portion 210. The sides 258*a* and 258*b* of the insert 250 toward its upper end 260 will contact with the sidewalls 210*b* and 210*c* of recess 210 before the insert 250 slides out the bottom of the hollowed out portion 210. These tapers only allow the insert 250 to be installed or removed in one direction, i.e., through the inlet. The inlet is preferably at the top end of the recess 210, which allows gravity and the resilient member 302 to hold the insert into the correct position during installation and removal. These complementary tapering surfaces also keep the insert 250 engaged with the spool 200 during shipping, installation and removal of the spool.

The tapering of the sidewalls 258*a* and 258*b* of insert 250 from back to front and the complementary tapering of the sidewalls 210*b* and 210*c* of recess 210 from back to front function to prevent loss of insert 250 through the open space 210*d* in recess 210. As best seen in FIGS. 5B, 6D and 6E, the sidewalls 258*a* and 258*b* of the insert 250 are tapered in a direction from the rear surface 252 to the front surface 256 (i.e., taper angle B in FIG. 5B). The side walls 210*b* and 210*c* of the hollowed out portion 210 have a similar taper angle. Because the width $W_2$ of rear surface 252 of the insert (see FIG. 5B) is wider than the corresponding width of the open space 210*d* of the hollowed out portion 210, the insert 250 cannot be moved perpendicularly out of the hollowed out portion 210 through the open space 210*d*. These retention features help keep the insert 250 and spool 200 together to prevent loss or accidental separation while still allowing relatively easy insertion of the insert 250 into the hollowed out portion 210 and relatively easy removal of the insert 250 from the hollowed out portion 210.

Figure 7C:
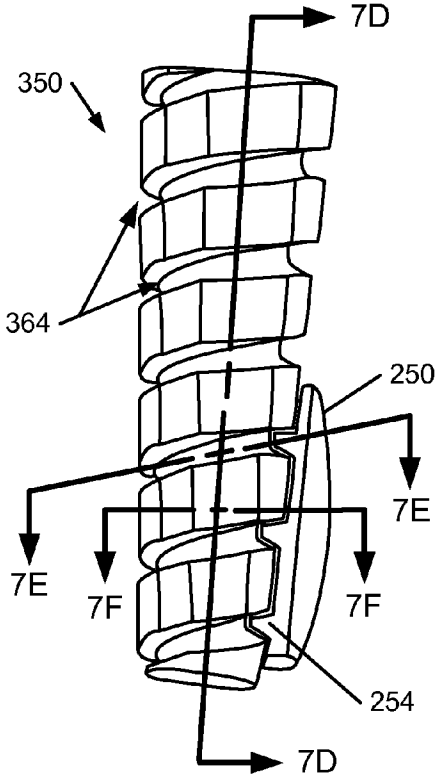
FIG. 7C is a side view of the wedge engaged with the insert.
Figure 7B:
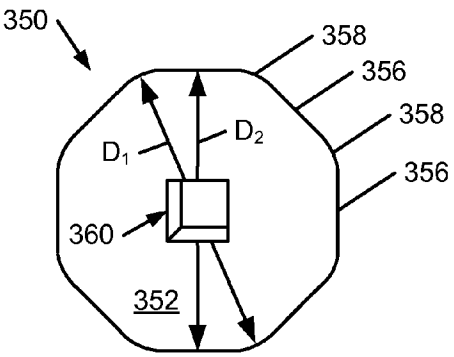
FIG. 7B is a top view of the wedge.
Figure 7A:
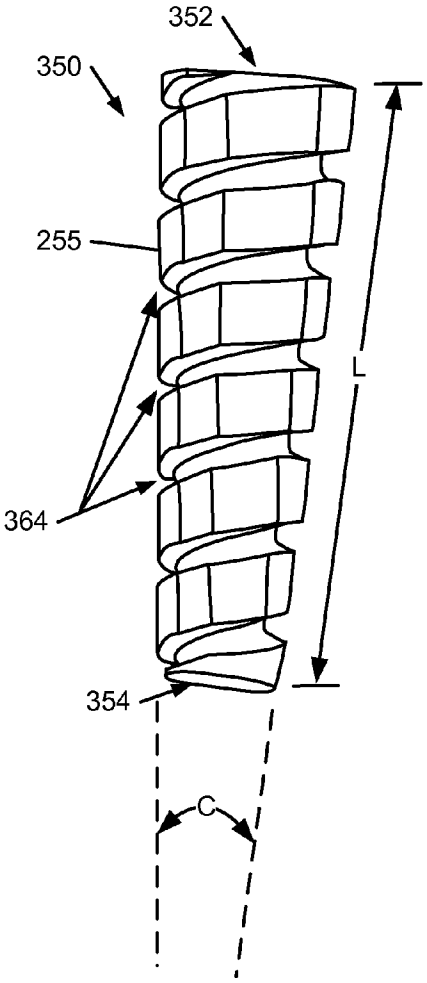
FIG. 7A is a side view of a wedge for use in a lock in accordance with the invention.

FIGS. 7A and 7B illustrate an example wedge 350 that may be used in locks in accordance with the invention. As shown, the wedge 350 has a generally rounded cross sectional shape and is generally frusto-conically shaped (a truncated cone) from top to bottom wherein the angle of taper (angle C in FIG. 7A) is preferably within a range from 2° to 15°, and in one embodiment is about 7°, though other tapers could be used. The wedge 350 extends from its trailing or top end 352 to its leading or bottom end 354, and the overall diameter (or other cross-sectional dimension) of the wedge 350 decreases continuously and consistently from the top-to-bottom (or longitudinal) direction L. In this example, the rounded wedge 350 preferably has a generally octagonal cross-sectional shape with eight side edges 356 (e.g., flats) and rounded corners 358 between the adjacent side edges 356, as shown in FIG. 7B, but could be shaped to have a circular cross section or have a different number of facets. The octagonal cross-section also helps avoid undesired loosening of the wedge during digging. The facets can also help avoid self-indexing of the wedge 350 down into the hole, i.e., where elastic deformation of the components under heavy load result in the wedge being drawn farther into the assembly. Although such self-indexing increases the tight fit, the tightness can in certain circumstances exceed the ability of the worker's tools to remove it from the assembly. In one example, octagonal wedge 350 will have a corner-to-corner diameter $D_1$ and a slightly smaller flat-to-flat diameter $D_2$, as shown in FIG. 7B. When using a faceted wedge, resilient member 302 will permit the needed oscillation of insert 250 (see, e.g., force F in FIG. 6D) to facilitate rotation of the wedge until lock 150 has fully tightened the wear member 106 on the support structure 102.

FIG. 7B further illustrates that the top end 352 of the wedge 350 may include an engagement structure 360 for engaging a tool used to turn the wedge 350 within the coupling assembly (e.g., a manual or powered tool for rotating the wedge 350). While this illustrated tool engagement structure 360 is a square hole (for receiving the square end of a wrench, socket, or other tool), other engagement structures may be used without departing from this invention, such as other hole shapes (e.g., other polygons (such as hexagons), other non-circular curved recesses, etc.), hex head bolts, etc. If desired, both the top surface 352 and the bottom surface 354 of the wedge 350 may include engagement structures for engaging a tool to turn the wedge (e.g., structure 360), so that the wedge 350 may be engaged and turned from either its top or bottom.

The wedges 350 of these illustrated examples further include threads 364 regularly spaced along the longitudinal length L of the wedge 350. These threads 364 are sized and spaced so as to engage with the thread segments 254 of the insert 250, as illustrated in FIGS. 7C through 7F. The outer surface 256 of the insert 250 generally matches the shape of the two rounded corners 358 and an adjoining edge 356 of the wedge 350 that it receives. While the illustrated example structure shows an insert 250 with three thread segments 254 engaging three locations on the threads 364 of the wedge 350, any desired number of thread segments 254 may be provided on the insert 250 without departing from this invention. The wedge 350 may be made from any desired materials (e.g., steel), in any desired manner (e.g., by casting or machining), without departing from this invention.

Figure 7E:
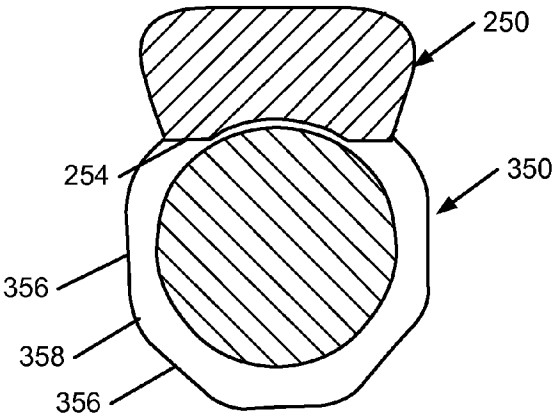
FIG. 7E is a cross-sectional view taken along line 7E-7E in FIG. 7C.
Figure 7F:
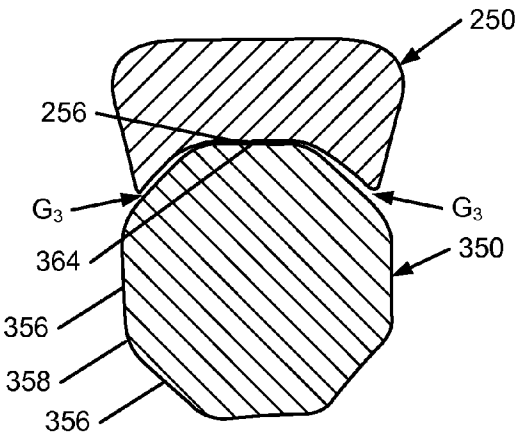
FIG. 7F is a cross sectional view taken along line 7F-7F in FIG. 7C.
Figure 7D:
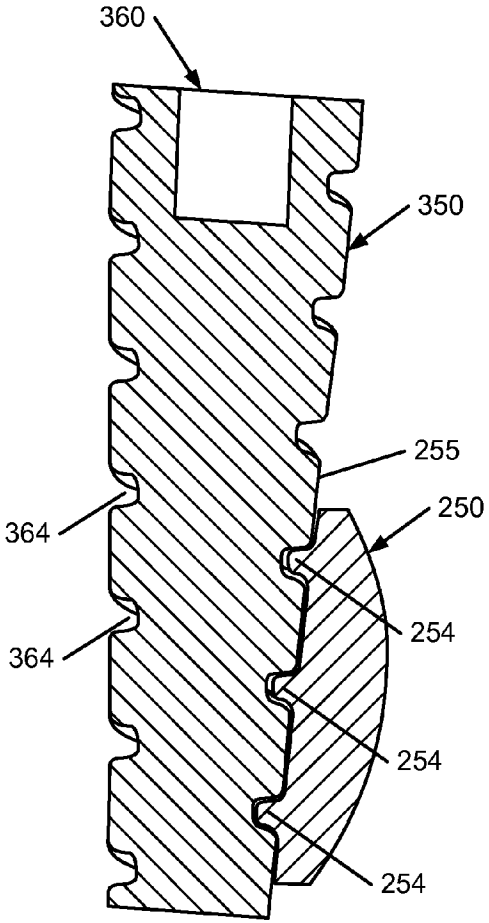
FIG. 7D is a cross-sectional view taken along line 7D-7D in FIG. 7C.

FIGS. 7D through 7F illustrate cross sectional views of the wedge 350 and insert 250 engaged with one another (for clarity, the spool 200 is not shown in these figures). As shown in FIG. 7D (a longitudinal length cross section), the thread segments 254 of the insert 250 engage the threads 364 of the wedge 350. This engagement enables the wedge to be driven into and out of the assembly as the wedge 350 is rotated with respect to the insert 250, and prevents ejection of the wedge during digging. FIG. 7E generally shows a cross sectional view through a thread 254 of the insert 250 (and through the thread area 364 of the wedge 350 into which the thread 254 fits). As shown in FIGS. 7D and 7E, the threads 254 of the insert 250 preferably do not reach all the way to the interior surface of the wedge 350 within the threads 364, as shown by the gaps between the threads 254 and the central portion of the wedge 350 in these figures, so that the bearing is carried by the larger land segments 255, which include flats 356 in the disclosed wedge 350. Nevertheless, other arrangements are possible.

FIG. 7F generally shows a cross sectional view through the areas of the wedge 350 and insert 250 outside of the threads 364 and 254. The wedge 350 and insert 250 will bear against one another on the flats 356 (i.e., the areas between the threads 254 and 364), and not on the threads 254 and 364. As shown in FIG. 7F, one flattened edge 356 of the wedge 350 fits into the flattened faceted area of the front surface 256 of the insert 250 while the adjacent flattened edges 356 of the wedge 350 are separated from the insert 250 by gaps $G_3$. Gaps $G_3$ are dimensioned to facilitate receipt of the increasing diameter of the wedge as it is driven into the wear assembly. The presence of the resilient material 302 helps the wedge 350 to be turned with respect to the insert 250 (i.e., the traveling of the insert 250 allows the wider corner-to-corner diameter $D_1$ of the wedge to rotate over the flat top surface 256 of the insert (by displacing the resilient material) and then the resilient material 302 pushes the insert 250 back into engagement with the wedge threads 364 when the smaller flat-to-flat diameter $D_2$ of the wedge 350 is located in the thread segment 254). The sizes of the gaps $G_3$ also will change somewhat depending on the extent to which the wedge 350 is located within the connection assembly (when a narrow cross section of the wedge 350 engages the insert 250, the gaps $G_3$ will be relatively large and when a wide cross section of the wedge 350 engages the insert 250, the gaps $G_3$ will become smaller or may even disappear). Thus, the gaps $G_3$ allow the wedge 350 to be inserted to any depth and help maintain flat 356 on flat 256 engagement between the wedge 350 and the insert 250. During digging, either of the gaps $G_3$ may at times be closed as side walls 210*b*, 210*c* support and stabilize the wedge and engagement of the threads to prevent loss under heavy loading.

The assembly and operation of one example of a wear assembly 400, including the example parts shown and described above in conjunction with FIGS. 1A through 7F, will be described in more detail in conjunction with FIGS. 8A through 8E. As an initial step, as shown by arrow 402 in FIG. 8A, the insert 250 (if not already done at the time of manufacture) is slid into recess 210 through inlet 210*e* so that the insert 250 and the spool 200 are integrated together. The resilient insert 302 within recess 210 will urge the insert forward toward open space 210*d* (see FIG. 6E).

The upper end 261 of the front side 200*b* of spool 200 (i.e., between inlet 210*e* and the top end 214 of spool 200) is preferably formed as a trough 263 for clearance to receive that portion of the wedge 350 that has not been driven downward into engagement with insert 250. Because of the pivoting of spool 200 during installation and removal, the trough 263 preferably deepens as it extends away from inlet 210*e* to provide ample clearance to receive the wedge during initial installation (i.e., with the spool at its most forward orientation).

Figure 8A:
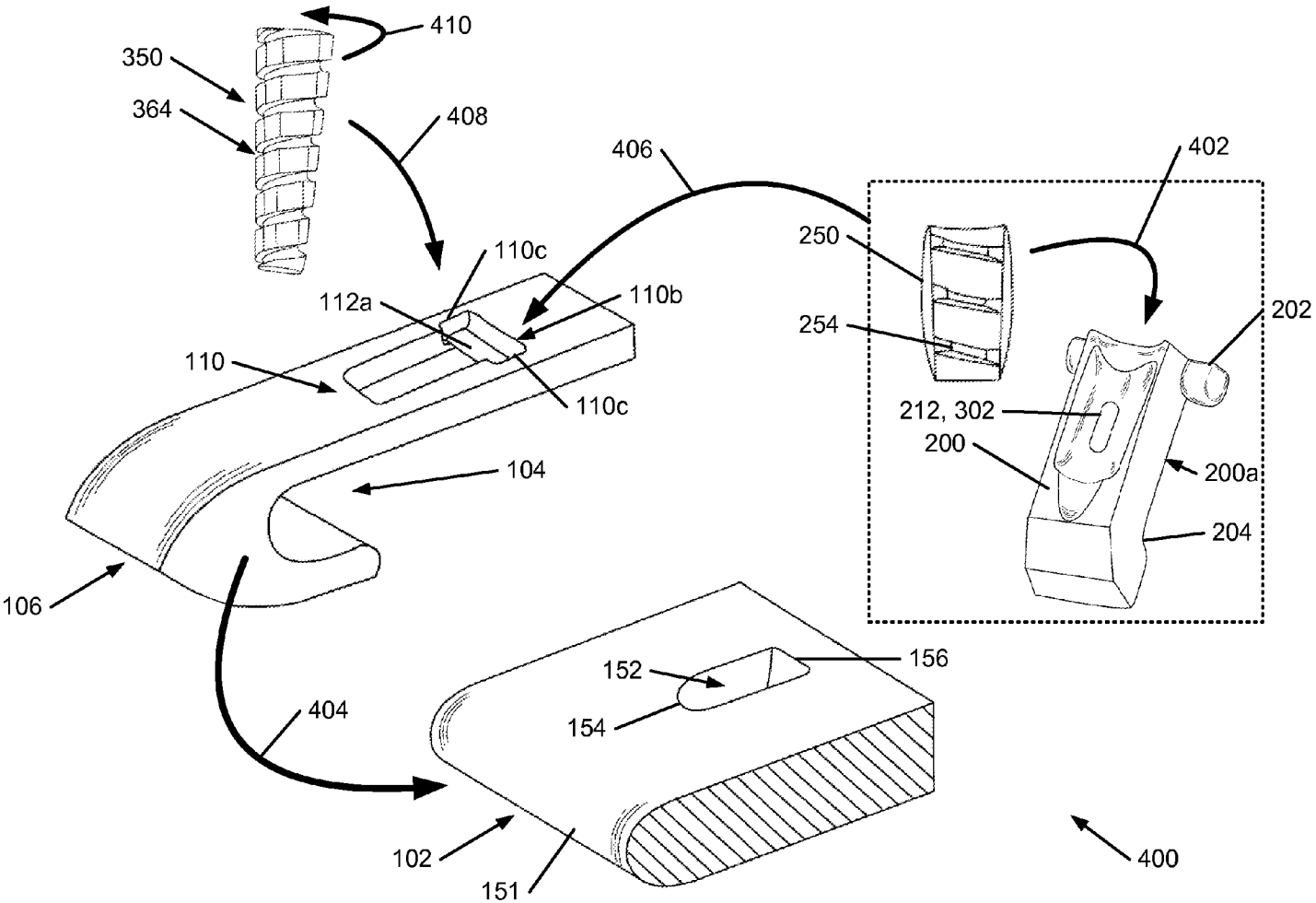
FIG. 8A is an exploded perspective view of a wear assembly in accordance with the present invention.

Next, the shroud 106 is fit over and around the front end 151 of the lip 102 as generally shown in FIG. 8A by arrow 404. Then, the spool 200 is fit into the aligned openings 110 and 152 of the shroud 106 and the lip 102, respectively, such that the generally C-shaped rear side 200*a* of the spool 200 fits around the ledge 112*a* and corner 156*d* defining the fulcrum 157 in the rear wall 156, which is generally shown by arrow 406 in FIG. 8A. More specifically, the lower bearing portion 204 of the spool 200 engages fulcrum 157 defined by mounting corner 156*d* of the lip 102, and bearing portion 202 extends over the ledge 112*a* of the shroud 106 to hold the shroud to the lip during digging. The side portions 209 of upper bearing portion 202 are fit within side portions 110*c* of the opening to hold the wedge in place during installation and removal of the wedge for an easier process and to prevent any accidental loss of the spool through the opening 152 in the lip 102.

At this time, the wedge 350 is inserted through opening 110 and into opening 152 along the front wall 154 of the opening 152 (as generally shown by arrow 408 in FIG. 8A). The insert 250 also is located and exposed within the opening 152 to engage the wedge. The wedge 350 is then turned (arrow 410) so that the threads 364 of the wedge 350 engage the thread segments 254 of the insert 250 and drive the wedge farther into the assembly. The stages of the wear assembly 400 during rotation of the wedge are illustrated in the partial cross sectional views of FIGS. 8B through 8E.

Figure 8B:
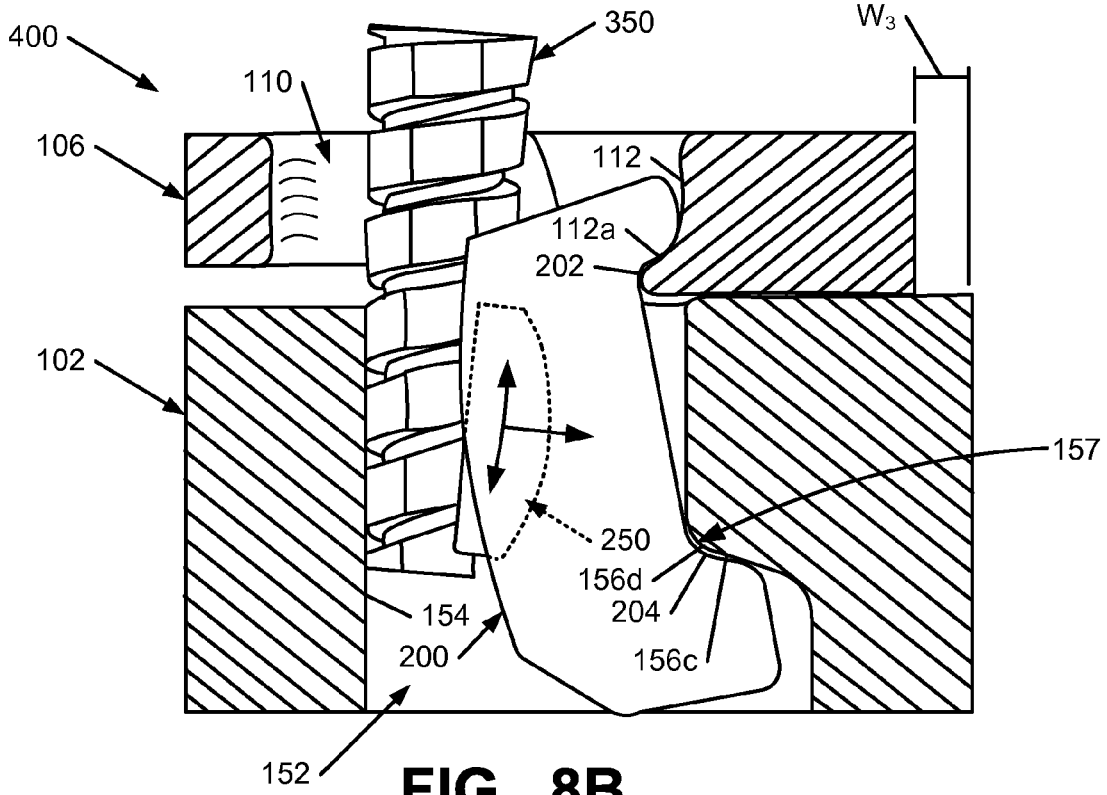
FIG. 8B through 8E illustrate the assembly and use of the coupling assembly of FIGS. 2A through 7F in accordance with the invention.

FIG. 8B illustrates the wedge 350 first making contact with and engaging the insert 250 mounted in the spool 200. As shown, at this time, the wedge 350 extends through the opening 110 in the shroud 106 and one side contacts the forward side 154 of the opening 152 in the lip 102. As noted above, if desired, this forward side wall 154 may be at least partially covered with a protective element (e.g., made from a harder material). This protective element optionally may be threaded instead of the spool to engage the threads 364 of the wedge 350. The threads on the wedge 350 engage the thread segments 254 of the insert 250. Because the narrowest portion of the wedge 350 is engaged between the wall 154 and the insert 250 at this stage, the insert 250 is in its bottommost position within recess 210 and in its most clockwise tilted position, which causes the spool 200 to be in its most counterclockwise tilted position (both of these positions are taken from the point of view of the renderings shown in FIGS. 8B through 8D), i.e., with bearing portion 202 just in contact with rear wall 112 of shroud opening 110. Because the spool 200 is in its most counterclockwise tilted position, because of the contact between the side portions 209 and front wall 110*d*, and because of the engagement of spool 200 with fulcrum 157, the shroud 106 is located at its most forward position with respect to the lip 102 with the wedge inserted and engaged, i.e., in an untightened position.

The wedge 350 may be turned and tightened to the extent necessary to firmly place the bearing surface 104*a* at the front end of the gap 104 between the legs 108*a*, 108*b* of the shroud 106 against the front end 151 of the lip 102. Tightening of the wedge 350 will first move the shroud 106 against the lip 102 to take up the gap between the parts. Further tightening will displace the resilient insert 302 in the hollowed out portion 210. The positioning shown in FIG. 8B might be applicable, for example, when the lip 102 and shroud 106 are in new or relatively new condition. Note the dimension "$W_3$" shown at the far right hand side of FIG. 8B, which shows the distance between the end edges of the shroud 106 and the lip 102. The dimension $W_3$ is simply a measurement of convenience to an arbitrary reference point on the lip and is not intended to reference the rear end of the lip (though it could be).

As the wedge 350 is driven into the wear assembly 400, the insert 250 is moved rearward by the downward movement of the wedge. This rearward movement of insert 250 causes the spool 200 to pivot or rotate rearwardly (i.e., clockwise as shown in the drawings) about fulcrum 157; i.e., lower bearing portion 204 of spool 200 remains engaged with mounting corner 156*c* defining the fulcrum for spool 200. Upper bearing portion 202 rotates rearwardly to press against rear wall 112 and push shroud 106 farther onto lip 102. This rotation of the spool causes the insert to translate along inner surface 210*a*. The insert 250, though, remains engaged with the wedge 350. Neither the wedge nor the insert rotate relative to the lip. While the insert will tend to be driven rearward, the insert 250 may not move much vertically relative to the lip 102 as the wedge is driven into the assembly.

This rotation of spool 200, caused by the interaction of wedge 350 with insert 250, results in considerably greater take up as compared to traditional Whisler arrangements or other non-traditional wedge and spool locks such as disclosed in U.S. Pat. No. 7,730,652. Although, as a practical matter, the actual rearward movement of a traditional spool may be made up of a series of irregular shifting motions (i.e., where one arm may move at times without the other), the overall movement of the traditional spool over time is to translate directly rearward. In the past, the spool was to have this linear rearward translation irrespective of whether the spool arms rode up ramps to pinch the wear member legs against the lip (such as shown in U.S. Pat. Nos. 7,730,652, 7,174,661 (FIG. 12), and U.S. Pat. No. 3,121,289) or simply laid over the wear member portions and exerted a rearward pushing force (such as shown in U.S. Pat. No. 7,174,661 (FIG. 8)). The take up provided by wedge and spool locks of the prior art was limited solely to the outward taper of the wedge. On account of balancing the force needed to install the wedge and lessening the risk of wedge ejection, the taper on such wedges has been modest, which, in turn, limits the available take up for the wear member. This novel use of the insert and pivoting of the spool results in a take up which is in some cases three to four times more than in prior wedge and spool locks without any increase in the taper of the wedge.

Figure 8C:
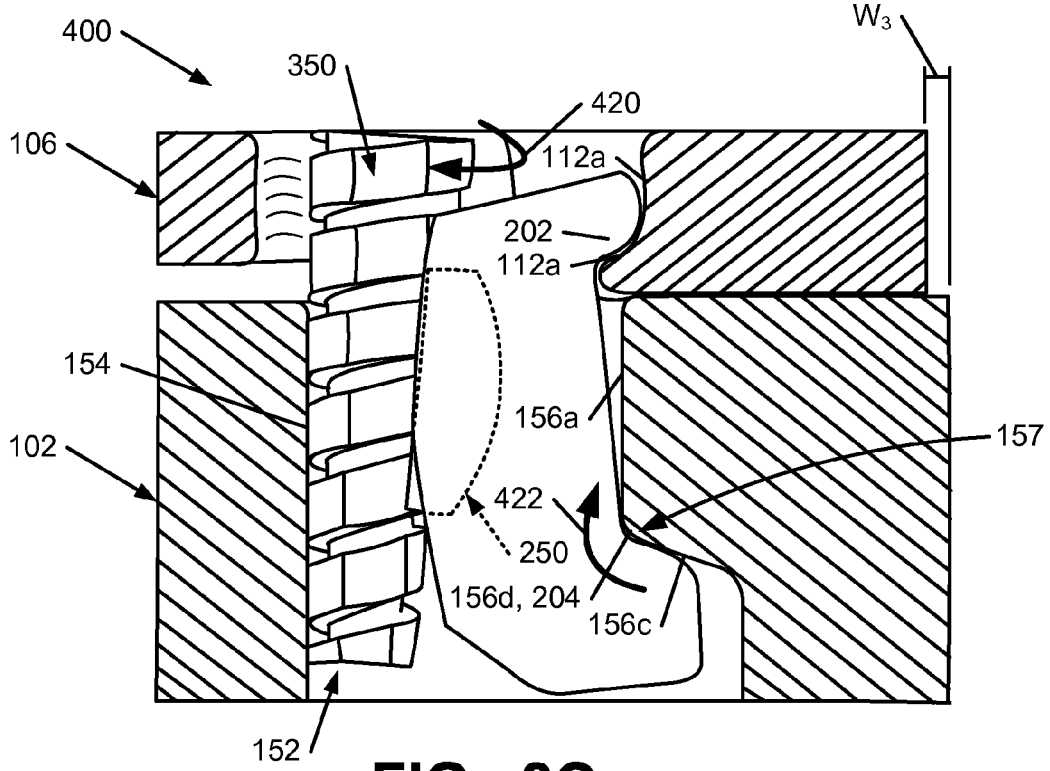
Figure 8D:
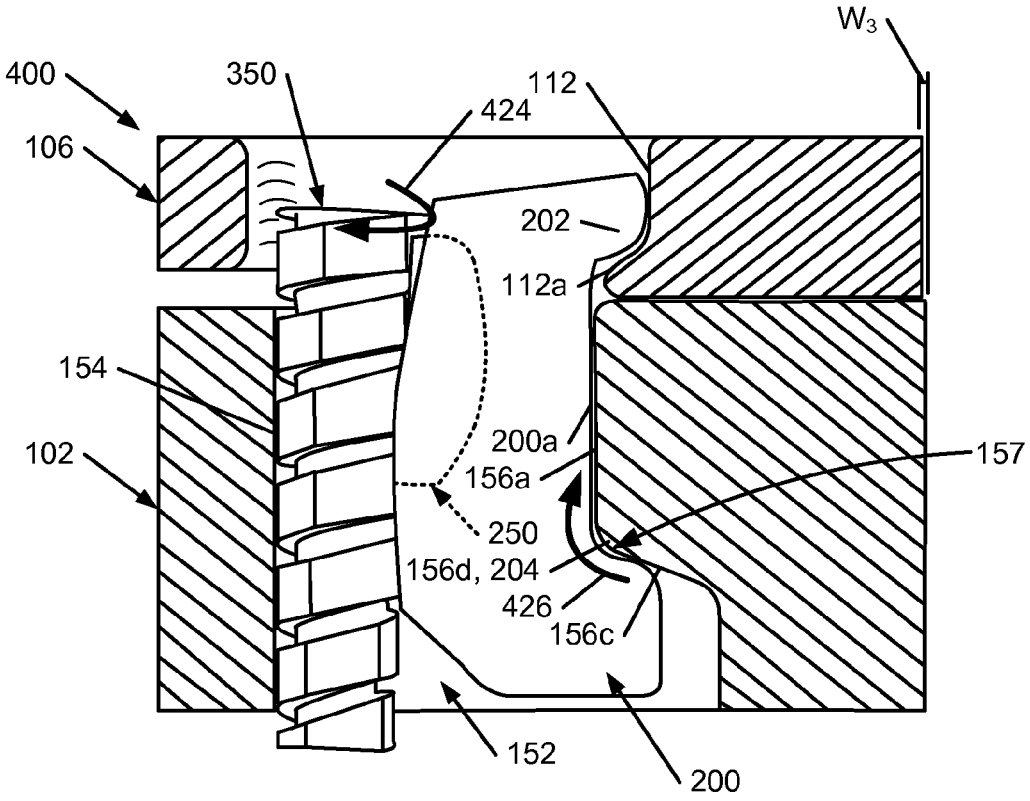
Figure 8E:
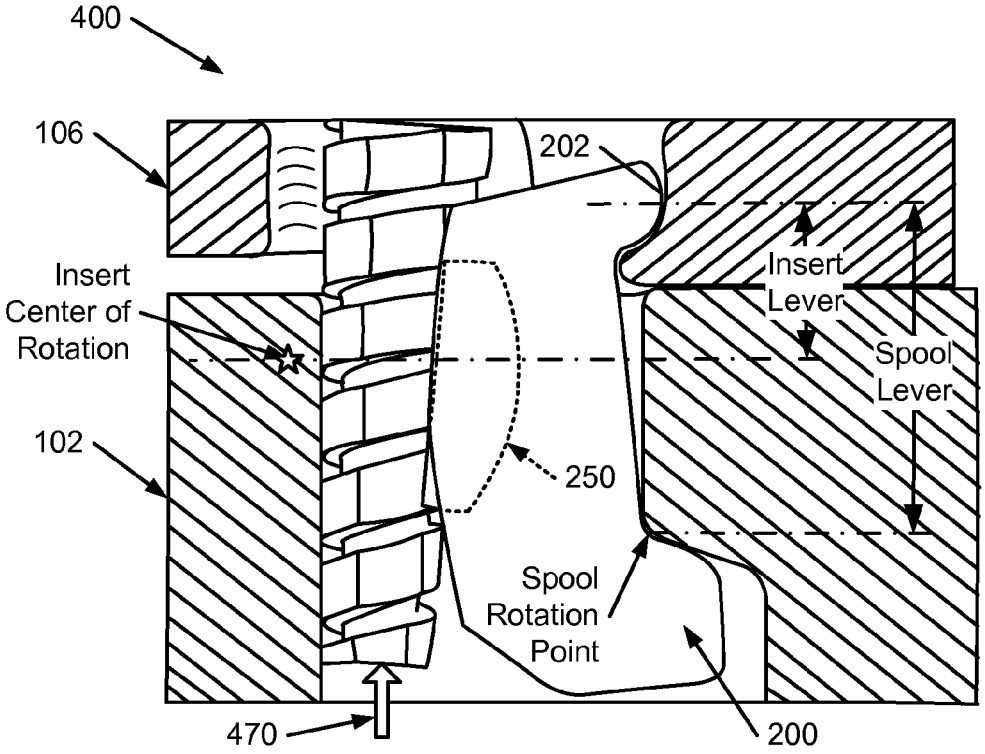

Reference is made to FIG. 8E to provide an additional explanation regarding the relationship of the movement of the insert 250 with respect to the rotation of the spool 200. Although the insert 250 does not rotate relative to the lip 102 or the wedge, a center of rotation (COR) of the insert is noted in the drawing to designate the point about which the insert moves relative to the spool (i.e., as the insert moves along the arcuate inner surface 210*a* when the spool 200 rotates about fulcrum 157). The vertical distance between the COR and the point of contact (POC) between the spool 200 and rear wall 112 of shroud 106 defines a "lever arm," which is called herein the insert lever. The vertical distance between the fulcrum 157 about which the spool rotates and the POC defines another "lever arm," which is called herein the spool lever. The closer in length the insert lever is to the spool lever, the more take up the coupling assembly will generate. In other words, if the spool 200 has a relatively long length above the Insert Center of Rotation, small movements of the insert rearward will produce relatively large movements at the opposite top end of the spool 200 (i.e., involving upper bearing surface 202). Additionally, the shorter the insert lever is relative to the spool lever, the higher the force that can be applied by the lock against shroud 106. In other words, the higher the center of rotation of the insert 250 is located with respect to the fulcrum 157, the greater the force that can be applied to move the shroud 106 during installation of the shroud 106. This is installation force only and not the allowable resistance to unwanted removal of the shroud 106 (which is a function of the section modulus of the spool 200 and not the driving force of the wedge 350).

The rotation of spool 200 about fulcrum 157 may result in an upward swinging of upper bearing portion 202 so as to form a slight gap between it and ledge 112*a* (if a gap didn't exist already). Whether a gap will be created depends on the relative angle of the spool with respect to the shroud. However, since the upper bearing portion 202 preferably does not normally pinch upper leg 108*a* against the lip, such a gap does not hinder the mounting of the shroud on the lip. Even in the rotated position, with the bearing surface 104*a* tightly against the front end 151 of lip 102, the upper bearing portion 202 still prevents upper leg 108*a* from having any undue movement away from the lip during digging.

Over the course of time and use (e.g., under the harsh conditions to which equipment of this type may be exposed during excavation), the front end 151 of the lip 102 will generally become worn and the fit of the wear member will loosen. As wearing occurs, the resilient insert 302 will at first push outward on the insert 250 to provide limited resistance to movement of the wear member under load. However, as wear continues and the gap between the shroud 106 and the lip 102 widens, even more movement will result, which may cause unwanted rattling and the like between the lip 102 and the shroud 106. Loose mounting of wear parts tends to increase wearing, and if it gets to be too great, increases the risk of wedge ejection. Accordingly, over time, a user may wish to retighten the coupling between the shroud 106 and the lip 102. Alternatively, the shroud may be designed to wear out at about the time retightening is needed so that the greater tightening of the wedge occurs at the time a new shroud is mounted on the lip. This retightening or further tightening can be accomplished by rotating the wedge 350 (as shown in FIG. 8C by arrow 420). This rotation forces the wedge 350 downward, beyond where it was previously, which forces a wider portion of the wedge 350 into the opening 152 between the wall 154 and the insert 250 (due to the longitudinal tapering of the wedge 350). As discussed above, the downward movement of the wedge 350 causes the insert 250 to move rearward and pivot the spool 200 rearward about fulcrum 157. This pivoting or rotating of the spool causes the insert 250 to slide farther along the inner surface 210*a* of recess 210 in spool 200 (shown in FIG. 8C by arrow 422). Rotation about the mounting corner 156*d* causes the upper bearing portion 202 of the spool 200 to move farther rearward, which in turn forces the shroud 106 to move farther rearward and in a tighter fit with lip 102. Note the change in dimension "$W_3$" between FIGS. 8B and 8C, which illustrates a portion of the take up available with this coupling assembly. This action can again seat the bearing surface 104*a* of the shroud 106 tightly against the front end 150 of the lip 102, thereby reducing undesired rattling and motion between the lip 102 and the shroud 106.

As additional use takes place, the front end 150 of the lip 102 may become further worn. This wear may again cause the coupling to become loose, which again may cause rattling, undesired movement between the lip 102 and the shroud 106, etc. Accordingly, the user may again wish to retighten the lock 150 between the lip 102 and the shroud 106 or initially tighten a new wear member onto a further worn lip. This can be accomplished by again rotating the wedge 350 (as shown in FIG. 8D by arrow 424). This additional rotation forces the wedge 350 downward beyond its previous location, which forces a still wider portion of the wedge 350 within the opening 152 between the wall 154 and the insert 250 (due to the longitudinal tapering of the wedge 350). The downward movement of the wedge 350 causes the insert 250 to move rearward, which in turn causes the spool 200 to further rotate clockwise about the mounting corner 156*d* (shown in FIG. 8D by arrow 426). Rotation about this rounded corner edge 156*d* causes the top portion of the spool 200 (including surface 202) to move rightward, which in turn forces the shroud 106 to move rightward. Note the change in dimension "$W_3$" between FIGS. 8C and 8D. This action can again seat the opening 104 of the shroud 106 tightly against the front end 150 of the lip 102, thereby reducing undesired rattling and motion between the lip 102 and the shroud 106.

FIG. 8D shows the coupling assembly 400 at substantially its maximum tightened extent, due to the substantial flush relationship between the surface 200*a* of the spool 200 and the surfaces 156*c*, 156*a*, and 112.

Notably, the arrangement described above in conjunction with FIGS. 8B through 8D allows for substantial take up, which can be utilized to repeatedly tighten new wear members onto an increasing worn lip (or other support structure) or to allow the assembly to be retightened multiple times over the course of use, as may be necessary or desired. Because of the relatively large available take up provided by this lock 150 (e.g., from 0.5 to 2 inches), these multiple tightening steps can be accomplished without the need to frequently build up the front end 151 of the lip 102.

As described above, the resilient member 302 applies a force that urges the insert 250 away from the inner surface 210 of the spool 200, which increases the engagement of the threads between the insert 250 and the wedge 350. The effect of this force is to push the spool 200 away from the wedge 350, and because the spool 200 is in direct contact with the wear member, it maintains some pressure on the wear member in an effort to tighten the fit of the shroud on the lip. In one example, the resilient member 302 provides about 4000 pounds of force in its most compressed condition, which as noted above is applied to hold the wear member against a lip. Thus, as the forces on the locking mechanism vary over the course of use (e.g., due to dynamic loading and impacts), the resilient member 302 helps maintain a tighter connection between the coupled parts, to reduce in a limited way deterioration of the parts caused by impact loading (and thus reduces the need or frequency at which the part(s) must be rebuilt). This feature is referred to herein as "elastic take up." The resilient member 302 also helps prevent undesired wedge rotation during use by holding the insert 250 and the wedge 350 in tight, friction force contact (particularly for polygonal cross section wedges, but also, to at least some degree, for round cross section wedges).

Notably, in this wear assembly 400, the various components are coupled together without a vertical clamping force (i.e., the spool 200 does not vertically clamp the shroud 106 to the lip 102 or apply a clamping force between surfaces 156*c* and 112*a*) under normal use. The lack of a vertical clamping force between the lip 102 and the shroud 106 substantially reduces the stresses on the spool 200 and makes the coupling and relative movement of the parts simpler and easier. An expansive, spreading force on bearing portions 202, 204 is applied only when a sufficiently large downward force is applied on front end 118 of shroud 106 such that upper bearing portion 202 functions to hold upper leg 108*a* to the lip 102.

In addition to the improved "take up" features described above, the rotating insert 250 that fits into the spool 200 may provide additional benefits. For example, the use of rotatable insert 250 provides for better alignment between the threads associated with the spool (i.e., those on the insert) with those on the wedge 350 than would otherwise be possible. The use of rotatable insert 250 also helps provide a smoother and more uniform loading between the spool 200 and the wedge 350. In other wedge and spool systems, the wedge and spool may not be well aligned (i.e., one component may be cocked slightly relative to the other), which can result in the presence of a pinch point somewhere along their interface, which produces a stress concentration point. This stress concentration point could be located anywhere along the path of engagement, e.g., near the bottom of the wedge/spool interface if the wedge has slightly too shallow of taper, near the top if the wedge has too wide a taper, somewhere in the middle if the spool is slightly out of tolerance, etc. Nonetheless, there will be some higher stressed point along the line of contact between the spool and the wedge. Locking mechanisms in accordance with the present invention, however, with the rotating insert 250, tend to automatically adjust to move away from a higher stress to a lower stress condition and thus tend to equalize the loading over the insert's length with the wedge and also uniformly seating the insert into the spool to provide a more uniform load on the spool. The reductions in stress provided by rotation of the insert as well as having no normal pinching of the wear member against the lip, leads to a longer useful life for lock 150 such that the locks can often be reused for mounting multiple successive wear members before they need to be replaced.

Another advantageous feature of locks according to the invention relates to the ability of the lock to actually tighten within the assembly if the wedge 350 is forced upward from the bottom (e.g., in the direction of arrow 470 in FIG. 8E) during digging. As one can readily appreciate, a conventional wedge normally loosens when forced upward out of its hole (due to the reduced thickness at the taper). Interaction between the spool 200, insert 250, and wedge 350 of the above example locking mechanisms according to the present invention, however, forces the present locking mechanism to become tighter if the wedge 350 is forced upward (e.g., by debris or other materials contacting the bottom of wedge 350 in the direction of arrow 470). More specifically, when an upward force is applied against the wedge, as shown by arrow 470 in FIG. 8E, the forcing of the wedge 350 upward will also force the insert to move upward on account of the threaded engagement between the two components. Due to the connection of the insert 250 to the spool 200, the upward movement of the insert with the wedge will result in a tightening force in the lock which will result in the insert being forced tighter into the threads of the wedge, the wear member being tightened onto the lip or both. Regardless of the resultant movements, the end result is that such upward movement of the wedge tends to tighten the engagement of the wedge to resist ejection. This is an improvement over prior locks that rely upon the tightening force of a wedge, where such upward movement (in comparison to the present invention) results in a greater risk of wedge ejection. This tightening action considerably reduces the risk of wedge loss during use and helps maintain a stable connection between the secured parts.

Many variations in the wear assembly 400 and the individual components thereof are possible without departing from this invention. As some more specific examples, the various components, such as the spool 200, the insert 250, the wedge 350, and the wear member 106 may take on a variety of different sizes, shapes, and constructions without departing from this invention. In some examples, the lock components of the wear assembly 400 may substantially or completely fit within the openings 110 and 152 of the parts to be coupled. Also, the various components of the coupling system may be made from any desired materials without departing from this invention, such as steels, and the components may be manufactured in any desired manner without departing from this invention, such as through casting, forging, fabrication, or machining techniques. The spool 200, wedge 350 and insert 250 may be made of any suitable or desired materials for their intended application and in any suitable or desired manner without departing from this invention. For excavating equipment, the lock components are preferably cast in low alloy steel for strength, hardness and toughness. As noted above, locks in accordance with the invention including a wedge, spool and insert (as described above) can be used to secure other wear members in place, such as a point to an adapter. In this construction, the adapter nose would include the hole with the fulcrum and the point the hole with the rear wall to be engaged by the spool for holding the point to the adapter. Further, while the lock is shown only in a vertical orientation (which is common when installing a lock to hold a wear member (such as a shroud) to the lip of a bucket), it could be inserted horizontally (e.g., parallel to the lip), particularly when securing a point to an adapter or other such member to a base. Of course, references to relative terms such as vertical and horizontal are for convenience with reference to the figures. Excavating equipment is capable of assuming various orientations other than what is shown.

Figure 9A:
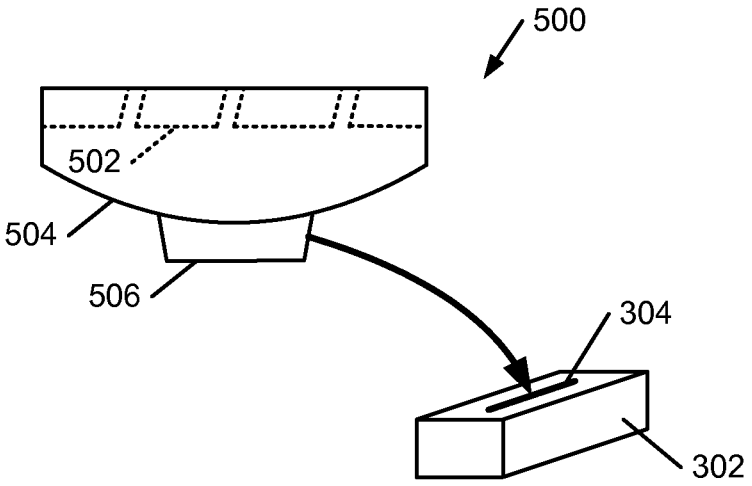
FIGS. 9A and 9B illustrate some potential variations on the structure of the insert that may be used in some example coupling assemblies in accordance with this invention.
Figure 9B:
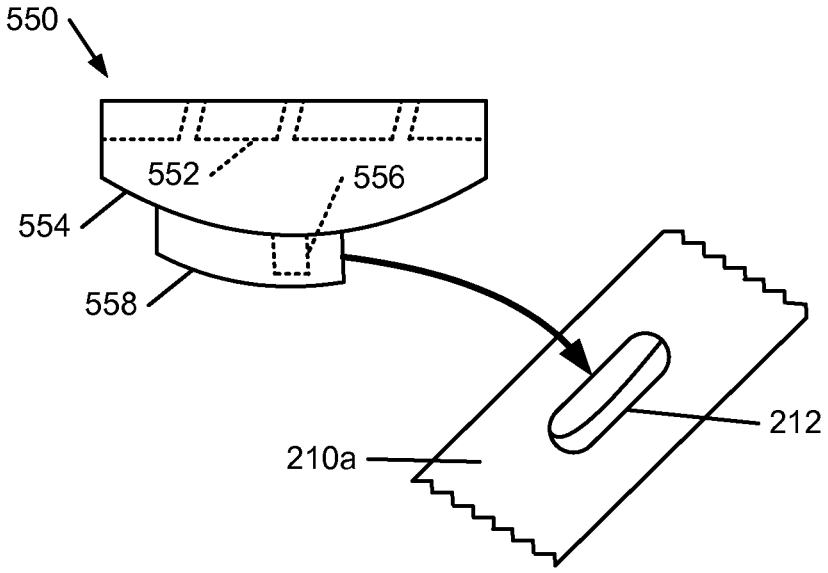

FIGS. 9A and 9B illustrate some potential variations on the insert that may be included in the spool 200. As noted above, the various tapers of the insert 250 and recess 210 function to hold the insert 250 to the spool 200, e.g., during shipping, installation and removal. These tapers (on both the insert 250 and the recess 210) are not required. For example, insert 500 is held to the spool without a tapered recess. The insert 500 shown in FIG. 9A includes an outer surface 502 that may be similar to the outer surface 256 for insert 250 described above (including the presence of thread segments). The inner surface 504 of this example insert structure 500 includes a rearwardly projection, relatively thin fin or rail 506. This fin or rail 506 may be received within the resilient member 302 in the hollowed out portion 210 of the spool 200, as generally described above in conjunction with FIGS. 4 and 6A through 6E. The fin or rail 506 and resilient member 302 can function to hold the insert 500 within the recess 210 when the spool 200 is not engaged in the wear assembly (e.g., during shipping, installation or removal). While the wedge 350 will tend to hold the various parts together in the final assembly and during digging, the tapers or fins also help prevent rotation of the insert during rotation of the wedge. The fin or rail 506 may ride along or be guided within a slit or groove 304 formed in the resilient member 302. In this alternative embodiment, the resilient member 302 would still function in the same general manner as described above, e.g., with respect to FIGS. 6D and 6E.

Figure 19:
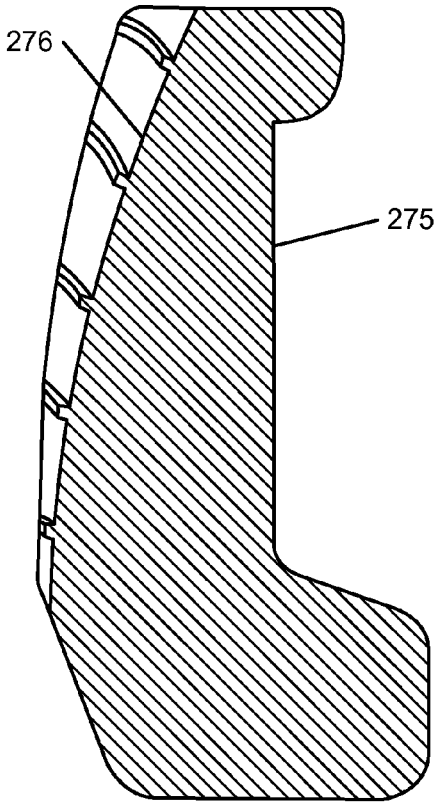
FIG. 19 is a cross-sectional view taken along line 19-19 in FIGS. 20.
Figure 20:
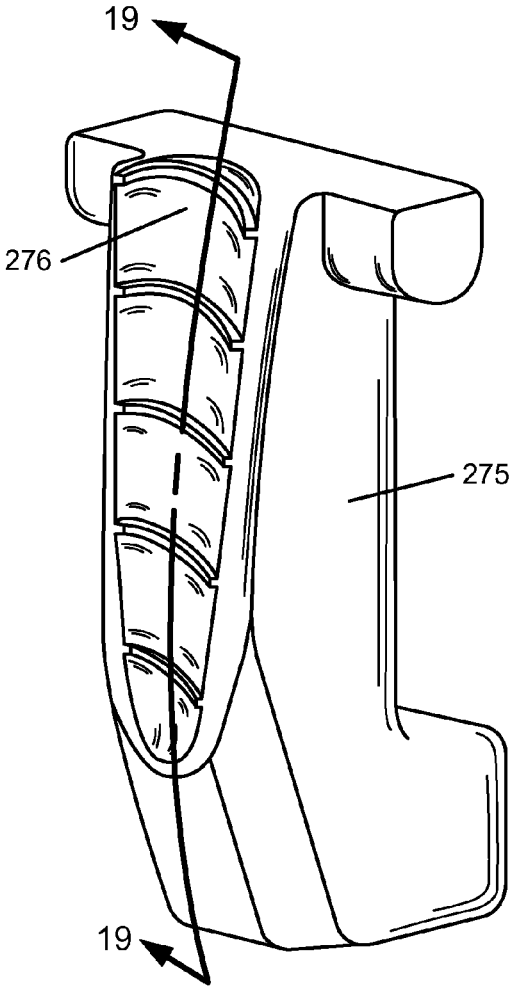
FIG. 20 is a perspective view of an alternative spool in accordance with the invention.

Other spool variations can be used. For example, a lock in accordance with the present invention may operate without an insert. In this example, the spool 275 is provided with a threaded trough 276 in which to engage with a threaded wedge 350 (FIGS. 19 and 20). The threaded trough is formed with a convex curve in a vertical direction (i.e., generally about a horizontal axis). In this embodiment, the engagement of the wedge with the convex threaded trough causes the spool to rotate about fulcrum 157 in a manner similar to spool 200 with insert 250. While this arrangement eliminates the need for the insert, the take-up capacity of this lock is reduced. As with spool 200, variations are possible. For example, the bearing portions may be changed, and the opening and ledge configuration can be different.

As another alternative of the invention, the resilient member need not be separate from the insert. For example, FIG. 9B illustrates an insert 550 that includes an outer surface 552 that may be similar to the outer surface 256 for insert 250 described above (including the presence of thread segments). The inner surface 554 of this example insert 550 includes one or more support pegs 556 (e.g., with a round, square, or other cross sectional shape) integrally formed (or fixed) therewith. The support peg(s) 556 may be covered with a resilient material 558 that is fixed to the support peg(s) 556 and/or the bottom surface 554 of the insert 550 (e.g., by adhesives or cements, by mechanical connectors, etc.). The peg with the resilient material 558 is placed in cavity 212 formed in the inner surface 210*a* of the hollowed out portion 210 of a spool 200 when the insert 550 is placed within the hollowed out portion 210. The peg(s) 556 and resilient material 558 help hold the insert 550 with the spool 200 when the spool 200 is not engaged in the overall coupling assembly (e.g., during shipping or installation). The wedge 350 will hold the various parts together in the final assembly without tapering walls of the recess. The resilient material 558 may be displaced as the insert 550 moves with respect to the spool 200. The resilient material 558 may function in the manner generally described above with respect to resilient member 302 in FIGS. 6D and 6E. A resilient member could also alternatively be secured directly to the insert when used to fit in recess 210.

Another example coupling assembly is described below in conjunction with FIGS. 10A through 14F. In this example wear assembly, the shroud 106 may have the same or similar structure to that illustrated in FIGS. 2A through 2C and described above. Accordingly, a more detailed description of this shroud 106 is not repeated here. Likewise, the wedge in this example coupling assembly may be the same as or similar to the wedge members 350 described above in conjunction with FIGS. 7A through 7F, and therefore, a more detailed description of this wedge 350 is not repeated here.

Figure 10A:
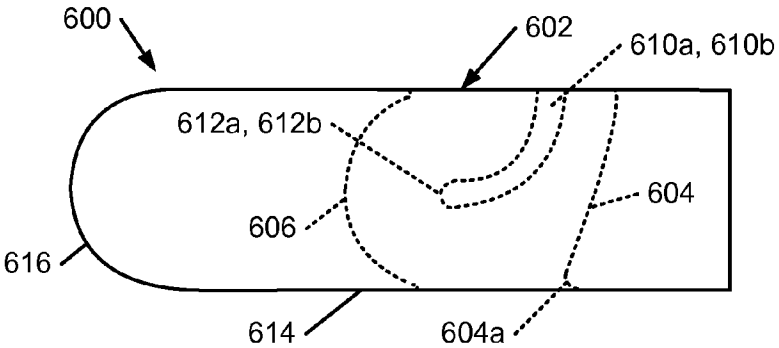
FIGS. 10A and 10B illustrate another example lip to which a wear member may be attached using coupling assemblies in accordance with another example of this invention.
Figure 10B:
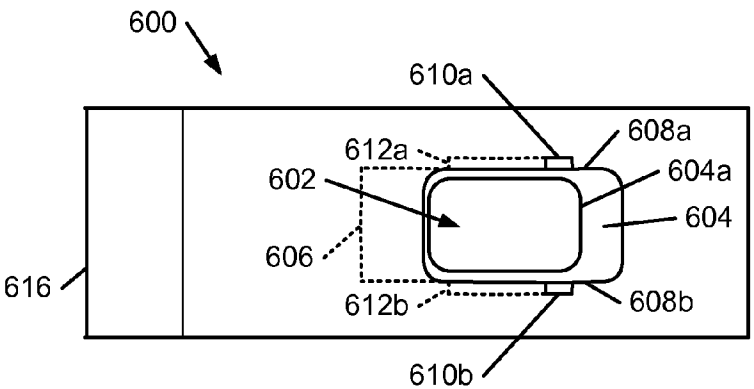

FIGS. 10A and 10B illustrate an example lip 600. While the exterior shape of lip 600 is similar to that of the conventional lip 102, lip 600 includes a non-conventional opening 602 that has a different configuration. The opening 602 in this example lip 600 includes a sloped rear wall 604 and generally concave front wall 606 (e.g., with a curved shape) for receiving a pivoting insert. The side walls 608*a* and 608*b* of the opening 602 include slots 610*a* and 610*b* for receiving support members of the pivoting insert.

Figure 11A:
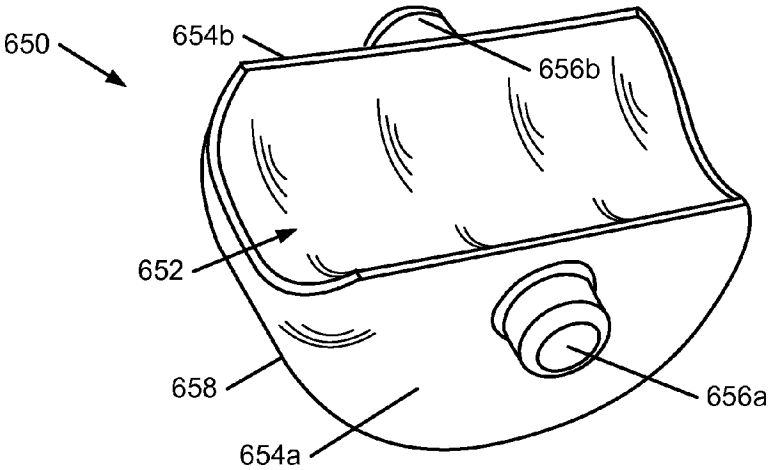
FIGS. 11A through 11C illustrate another example insert that may be used in coupling assemblies in accordance with another example of this invention.
Figure 11B:
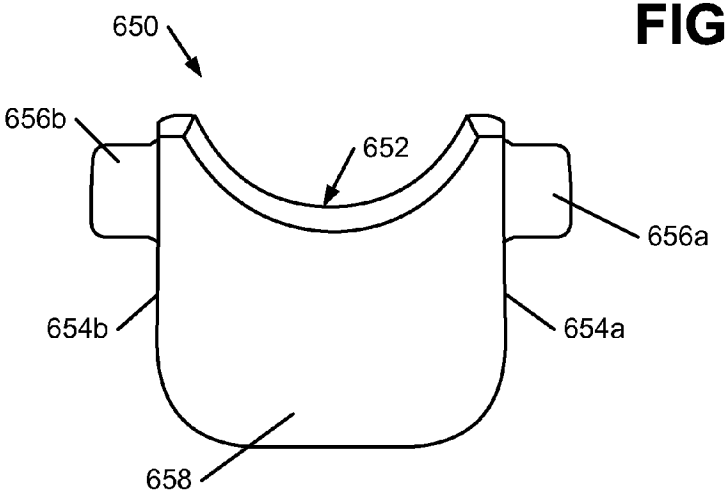
Figure 11C:
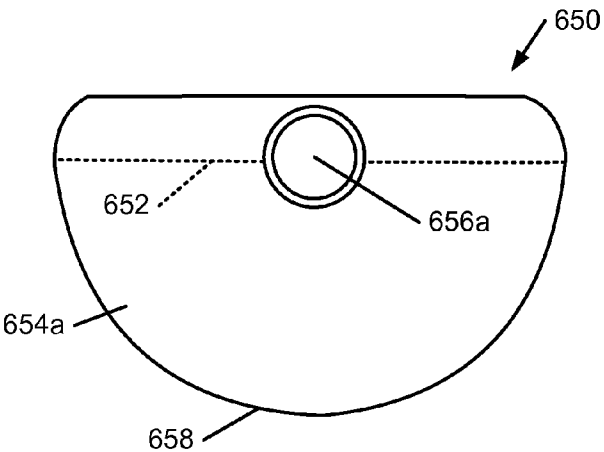

FIGS. 11A through 11C illustrate various views of a pivoting insert 650 that may be included in the lip 600 described above in conjunction with FIGS. 10A and 10B (FIG. 11A is a perspective view, FIG. 11B is a side view, and FIG. 11C is a front view of the pivoting insert 650). This pivoting insert 650 includes a hollowed out or concave bearing surface portion 652. Each side 654*a* and 654*b* of the insert 650 includes an outwardly extending support member 656*a* and 656*b*, respectively. The support members 656*a* and 656*b* may be in the form of cylinders (or frusto-conical members) that extend laterally away from the sides 654*a* and 654*b* in opposite directions. These support members 656*a* and 656*b* fit into the slots 610*a* and 610*b* provided in the side walls 608*a* and 608*b* of the opening 602 of the lip 600. The support members 656*a* and 656*b* may be sized and shaped with respect to the slots 610*a* and 610*b* so that the support members 656*a* and 656*b* can freely slide along the slots 610*a* and 610*b* and so that the support members 656*a* and 656*b* can rotate with respect to the lip 600 when the support members 656*a* and 656*b* are within the slots 610*a* and 610*b* (even at the blind ends 612*a*, 612*b* of the slots 610*a*, 610*b*).

When mounted in the lip 600, the pivoting insert 650 may be arranged such that its rounded exterior surface 658 extends within and is oriented proximate to the concave front wall 606 of the lip 600 and such that the concave bearing surface portion 652 faces rearward and is exposed within the opening 602 of the lip.

Figure 12:
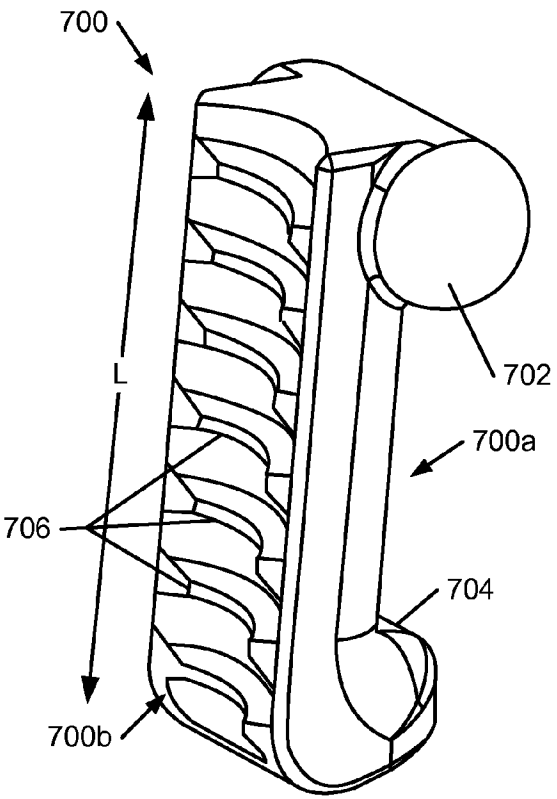
FIG. 12 illustrates another example spool that may be used in coupling assemblies in accordance with another example of this invention.

FIG. 12 illustrates a spool 700 that may be used in this example wear assembly in accordance with the invention. This spool 700 is similar to spool 200 described above in conjunction with FIGS. 4 and 6A through 6E in various ways. For example, spool 700 includes a similarly shaped rear side 700*a* including (a) a first bearing portion 702 that overlies the ledge 112*a* and contacts rear wall 112 of the shroud 106, (b) side portions that laterally extend from bearing portion 702 to fit into the wider side portions 110*c* of the opening 110 in the shroud 106, and (c) a second bearing portion 704 that engages the lip 600 (e.g., the rounded corner 604*a* at the bottom surface 614 of the lip 600, which defines a fulcrum 615 about which the spool rotates). In this example structure, the side 700*a* of spool 700 generally forms a C-shaped arrangement that fits into the openings 110 and 602 of the shroud 106 and lip 600, respectively.

The front side 700*b* of spool 700, opposite the side 700*a*, includes thread segments 706 that engage with the threads 364 provided on the wedge 350. The thread segments 706 extend about ⅓ to ⅕ of a full circumference and are spaced apart along substantially the entire longitudinal length L of the spool 700. While any number of individual thread segments 706 may be provided along the longitudinal length L of the spool 700 (e.g., from 2 to 15), the illustrated example includes 7 thread segments 706. The thread segments 706 are integrally formed as part of the spool 700 structure, e.g., using any desired fabrication technique, such as casting.

Figure 13:
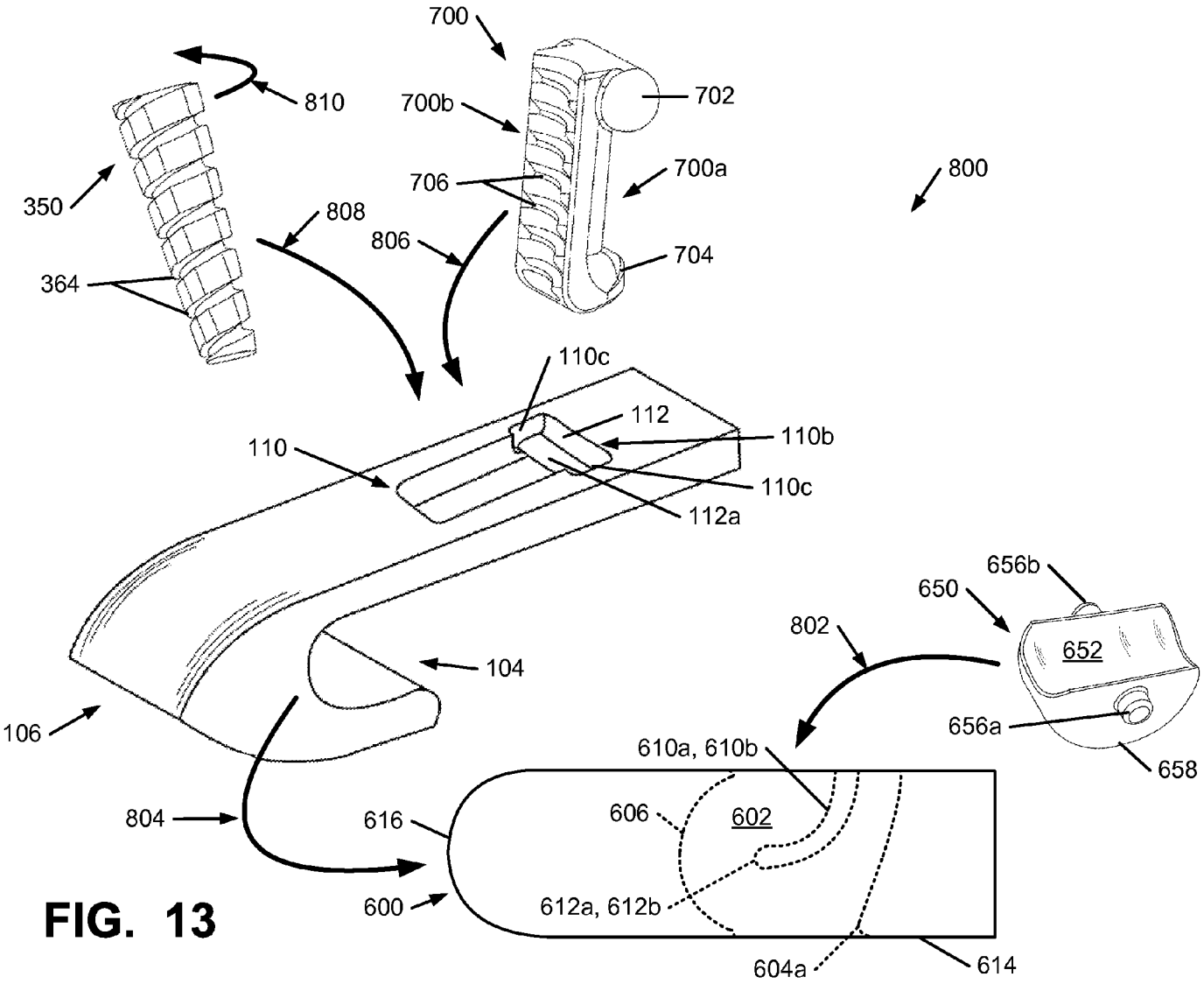
FIG. 13 is an exploded, perspective view of an alternative wear assembly in accordance with the invention.

FIG. 13 generally illustrates the steps involved in assembling the wear assembly 800 according to this example of the invention. First, as shown by the arrow 802 in FIG. 13, the support members 656*a* and 656*b* of the pivoting insert 650 are slid into the slots 610*a* and 610*b* of the opening 602 of the lip 600. Once the support members 656*a* and 656*b* reach the ends 612*a* and 612*b* of the slots 610*a* and 610*b*, the pivoting insert 650 may be rotated (if necessary) so that its curved front surface 658 faces and lies adjacent the concave front wall 606 of opening 602 and so that its concave surface 652 is exposed within the opening 602 (the pivoting insert 650 may rotate relatively freely on its supports 656*a* and 656*b* when it is mounted in the slots 610*a* and 610*b*).

Then, the shroud 106 is fit over the lip 600 with the pivoting insert 650 so that lip is received in the gap 104 of the shroud 106 defined between the legs 108*a*, 108*b* until bearing surface 104*a* contacts the front end 616 of the lip 600. This action is generally illustrated in FIG. 13 by arrow 804. Once the shroud 106 is set onto the lip 600, the spool 700 is inserted through opening 110 and opening 602 so that lower bearing portion 704 engages the mounting corner edge 604*a* of the lip opening 602 and such that the upper bearing portion 702 extends over the ledge 112*a* of the shroud 106 and into the laterally extending side portions 110*c* of the opening 110. This step is shown in FIG. 13 by arrow 806. At this time in the assembly process, the various parts of the wear assembly 800 are relatively loose.

Once assembled to the extent described above, the wedge 350 is inserted into the opening 110 (shown generally in FIG. 13 by arrow 808). Once in position, the wedge 350 is rotated (shown by arrow 810) to engage the threads 364 of the wedge 350 with the thread segments 706 of the spool 700. Partial cross sectional views of the finally assembled coupling assembly 800 are shown in FIGS. 14A through 14F.

Figure 14A:
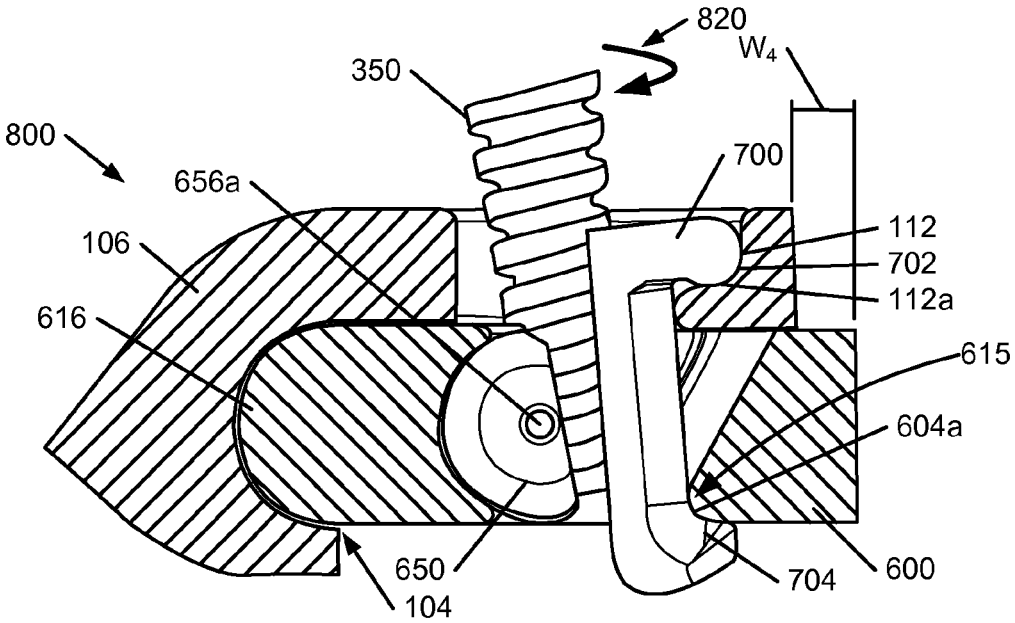
FIGS. 14A through 14F illustrate the assembly and use of the alternative coupling assembly of FIGS. 10A through 12C in accordance with this invention.

FIGS. 14A through 14F further illustrate the advantageous and improved "take up" features of the coupling assembly 800 in accordance with examples of this invention. FIG. 14A illustrates the wear assembly 800 as the wedge 350 engages the pivoting insert 650 and the spool 700. When the wedge 350 is initially tightened, as shown by rotation arrow 820 in FIG. 14A, the bearing surface 104*a* of the shroud 106 engages the front end 616 of the lip 600. The bearing portions 702 and 704 of the spool 700 overlie surface 112 and/or ledge 112*a* of the shroud 106 and against the rounded corner edge 604*a* of the lip 600 to force the shroud 106 rightward with respect to the lip 600 (based on the orientation shown in FIG. 14A).

At the point in time shown in FIG. 14A, a relatively narrow portion of the wedge 350 is engaged between the pivoting insert 650 and the spool 700. The wedge 350 may be turned and tightened to the extent necessary to firmly place the bearing surface 104*a* of shroud 106 against the front end 616 of the lip 600. The positioning shown in FIG. 14A might be applicable, for example, when the lip 600 and shroud 106 are in new or relatively new condition. Note the relatively wide distance between the right ends of shroud 106 and lip 102, as shown by dimension "$W_4$" in FIG. 14A. The dimension $W_4$ is simply a measurement of convenience to an arbitrary reference point on the lip and is not intended to reference the rear end of the lip (though it could be).

Figure 14B:
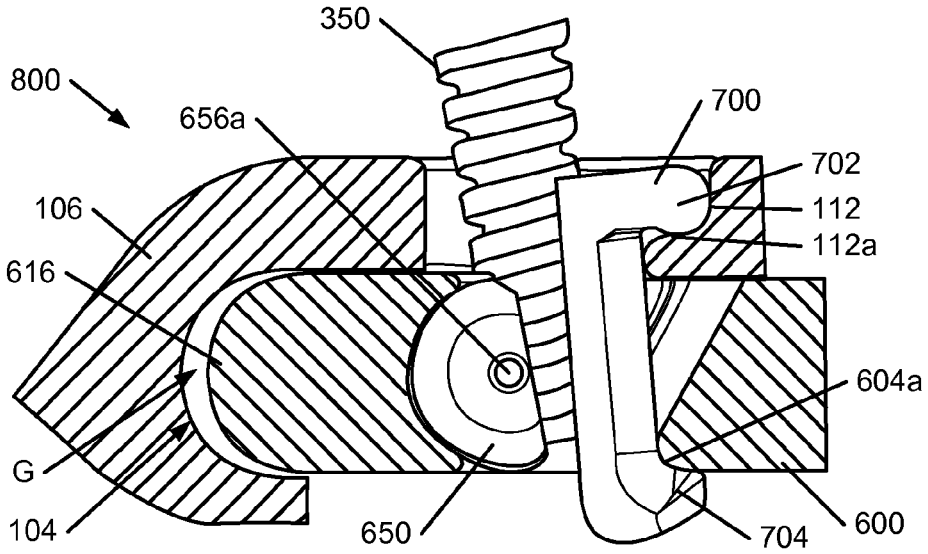
Figure 14C:
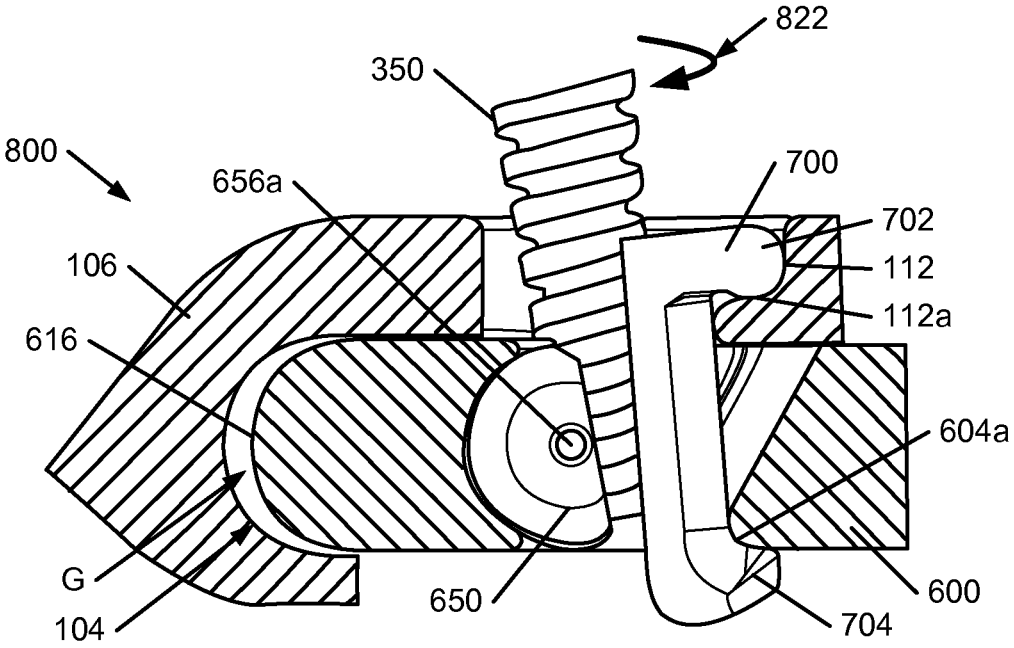

Over the course of time and use (e.g., under the harsh conditions to which equipment of this type may be exposed during excavation), the front end 616 of the lip 600 may become worn. This is shown in FIG. 14B by the gap G that has developed between the front end 616 and the interior surface of the opening 104 (the gap G being the result of material of the lip 600 and/or the shroud 106 ablating away). Such wearing will cause the shroud to be loose on the lip, which may cause rattling and other undesired movement between the shroud 106 and the lip 600, which may cause accelerated wear, etc. Accordingly, over time, a user may wish to retighten the coupling between the lip 600 and the shroud 106. This can be accomplished, in this example coupling assembly 800, by rotating the wedge 350 with respect to the remainder of the assembly 800 (as shown in FIG. 14C by arrow 822). This rotation forces the wedge 350 downward, which forces a wider portion of the wedge 350 within the openings 110 and 602 between the pivoting insert 650 and the spool 700 (due to the longitudinal tapering of the wedge 350). Alternatively, the need to retighten may correspond to the need to replace a worn wear member with a new one such that further tightening applies to the mounting of a new wear member instead of retightening one already in use.

Figure 14D:
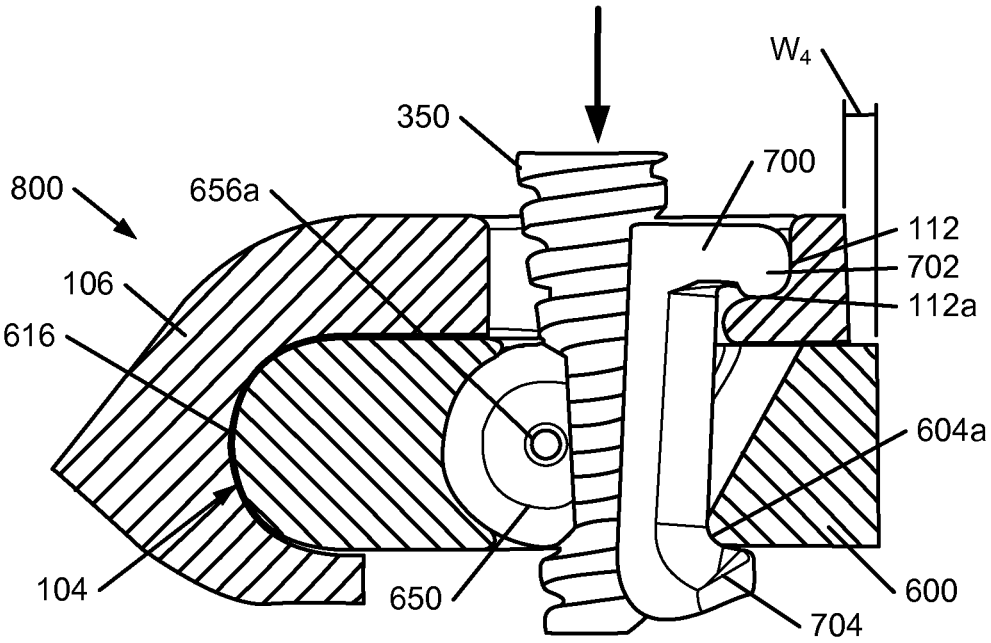

The downward movement of the wedge 350 causes the insert 650 to rotate clockwise (from the perspective of FIGS. 14C and 14D) around its support members 656*a* and 656*b*, which in turn causes the spool 700 to rotate clockwise about the rounded corner edge or fulcrum 604*a* (shown by a comparison of the various positions of elements in FIGS. 14C and 14D). Rotation about mounting corner 604*a* causes the top portion 702 of the spool 700 to move rearward, which in turn forces the shroud 106 to move rearward and farther onto the lip (as shown in FIGS. 14C and 14D). This action will again seat the shroud 106 firmly against the front end 616 of the lip 600, thereby reducing undesired rattling and motion between the lip 102 and the shroud 106. No "build-up" of the front end 616 and/or the opening 104 is necessary. The reduced size of dimension "$W_4$," shown by a comparison of FIGS. 14A and 14D, illustrates a portion of the "take up" available in this coupling system.

Figure 14E:
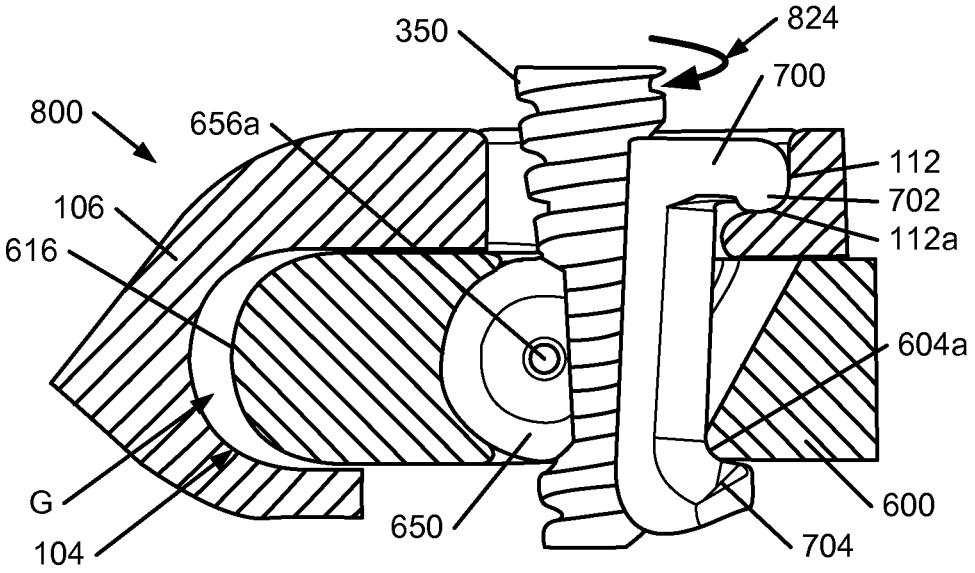

With additional use and wear over the course of time (e.g., under the harsh conditions to which equipment of this type may be exposed during excavation), the front end 616 of the lip 600 may become further worn. This is shown in FIG. 14E by the gap G that has again developed between the front end 616 and the interior surface of the opening 104 (the gap G being the result of material of the lip 600 and/or the shroud 106 ablating away). As stated before, this wearing action again may cause the coupling to become loose, which may cause rattling, undesired movement between the lip 600 and the shroud 106, accelerated wear, etc. Accordingly, the user again may wish to retighten the coupling between the lip 600 and the shroud 106 or mount a new shroud on the lip. As described above, this can be accomplished by further rotating the wedge 350 with respect to the remainder of the assembly 800 (as shown in FIG. 14E by arrow 824). This rotation forces the wedge 350 further downward, which forces a still wider portion of the wedge 350 within the openings 110 and 602 between the pivoting insert 650 and the spool 700 (due to the longitudinal tapering of the wedge 350).

Figure 14F:
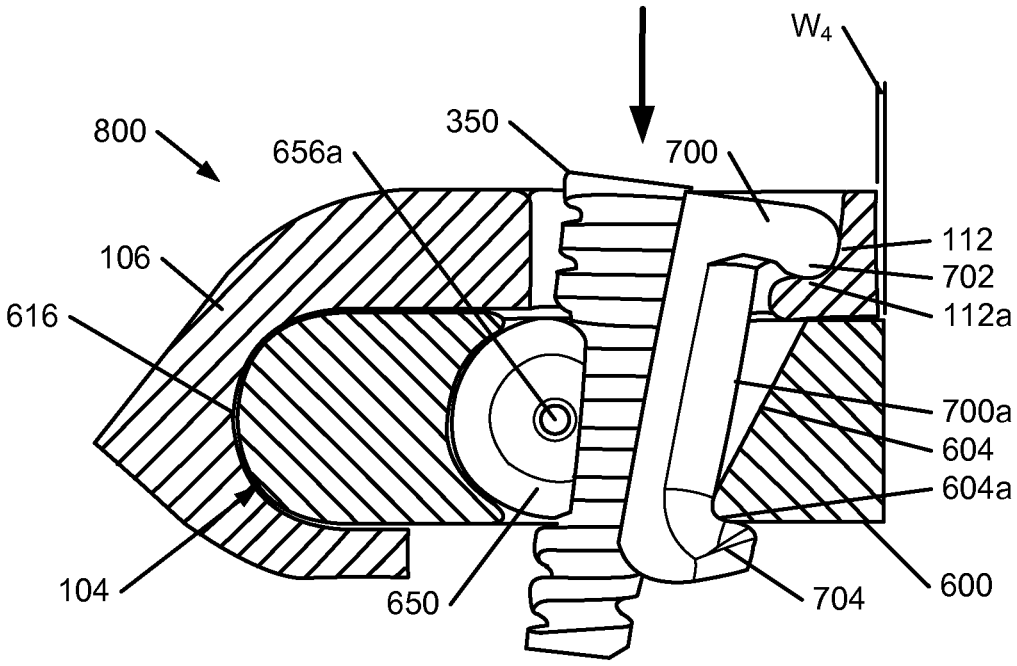
Figure 16A:
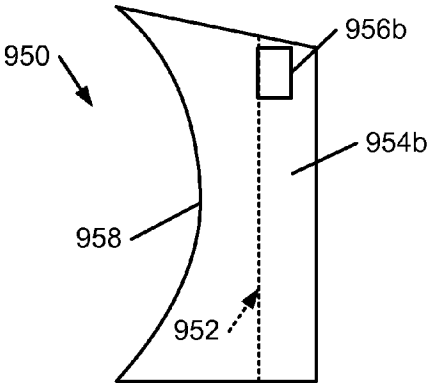
FIGS. 16A and 16B illustrate another example insert that may be used in coupling assemblies in accordance with another example of this invention.
Figure 16B:
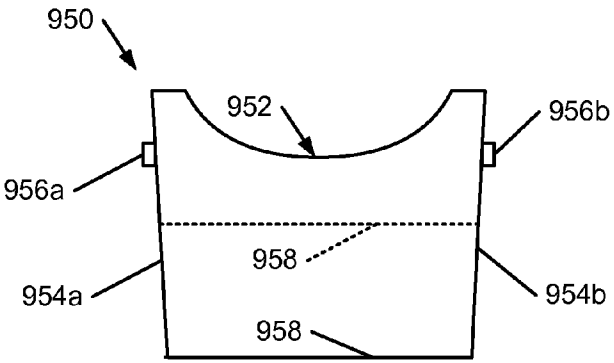

This further downward movement of the wedge 350 causes the insert 650 to further rotate clockwise (from the perspective of FIGS. 14E and 14F) around its support members 656*a* and 656*b*, which in turn causes the spool 700 to further rotate clockwise about the rounded corner 604*a* (shown by a comparison of the various positions of elements in FIGS. 14E and 14F). Rotation about this mounting corner 604*a* causes the upper bearing portion 702 of the spool 700 to move rearward, which in turn forces the shroud 106 to move rearward (as shown in FIGS. 14E and 14F). This action will seat the shroud 106 firmly against the front end 616 of the lip 600, thereby reducing undesired rattling and motion between the lip 102 and the shroud 106. This retightening action can be repeated as necessary, e.g., at least until the surface 700*a* of the spool 700 reaches the interior surface 604 of the lip 600.

Notably, from a comparison of FIGS. 14A through 14F, each of the wedge 350, pivoting member 650, and spool 700 pivot rearward (rightward in FIGS. 14A through 14F) as the wedge 350 is tightened to increase the take up (i.e., to increase the movement of the shroud 106 with respect to the lip 600). Note, for example, the change in dimension "$W_4$" in a comparison of FIGS. 14A, 14D, and 14F.

The arrangement described above in conjunction with FIGS. 13 through 14F allows for substantial and repeated movement of the shroud 106 (or alternatively the repeated mounting of successive shrouds) with respect to the lip 600, to thereby allow the wear assembly 800 to be tightened multiple times over the course of use. Because of the relatively large available "take up" in this wear assembly 800, these multiple tightening steps can be accomplished without the need to frequently "build up" the front end 616 of the lip 600 (e.g., by welding fresh material onto the lip). Also, in this wear assembly 800, the various components are coupled together normally without a vertical clamping force (i.e., the spool 700 does not vertically clamp the shroud 106 to the lip 600 or apply a clamping force between surfaces 112*a* and 614 except under certain vertical loads). The lack of a normal vertical clamping force between the lip 600 and the shroud 106 reduces the stresses on the spool 700 and makes installation and/or the relative movement of the parts simpler and easier. If desired, the bearing portion 702 of the spool 700 may not bear on the rear wall 112*a* of the shroud 106, optionally only at the lateral sides of these components (e.g., at or near side portions 110*c*).

Figure 15A:
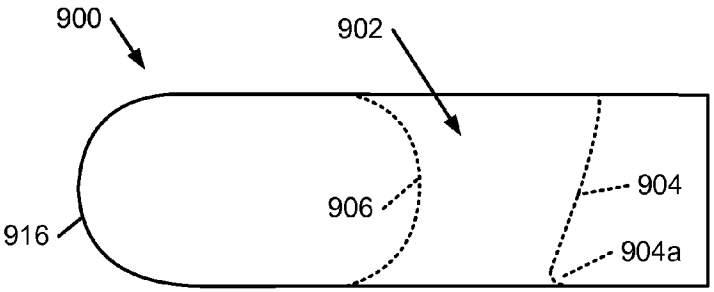
FIGS. 15A and 15B illustrate another example lip to which a wear member may be attached using coupling assemblies in accordance with another example of this invention.
Figure 15B:
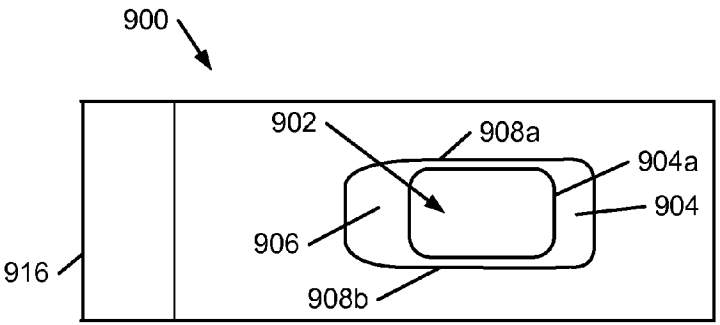

FIGS. 15A through 18 illustrate another variation in accordance with this invention. FIGS. 15A and 15B illustrate an example lip 900 that may be used in coupling assemblies in accordance with this invention. While the exterior shape of lip 900 may be the same as or similar to those of conventional lip 102, opening 902 will be different. The opening 902 in lip 900 includes a sloped rear wall 904 similar to that shown in FIGS. 10A and 10B (including a rounded bottom corner edge 904*a*) and an curve convex front wall 906 for receiving a movable insert, as will be described in more detail below.

Insert 950 includes a hollowed out or concave bearing surface 952. This bearing surface 952 engages a wedge in the finally assembled lock. Each side 954*a* and 954*b* of insert 950 includes a resilient strip member 956*a* and 956*b*, respectively. The resilient strip members 956*a* and 956*b* may be made from blocks of elastomeric material, such as rubber and the like. These resilient strip members 956*a* and 956*b* help support the pivoting insert 950 when it is mounted in the opening 902 of the lip 900 by engaging the side walls 908*a* and 908*b* of the opening 902. The pivoting insert 950 includes a rounded surface 958 opposite the bearing surface portion 952. The rounded surface 958 may have curvature that generally matches the curvature of the opening 902 front surface 906.

When mounted in the opening 902 of the lip 900, insert 950 is arranged such that its rounded exterior surface 958 is proximate to the bowed front wall 906 of the lip 900 and such that the concave bearing surface 952 faces rearward and is exposed within the opening 902 of the lip 900. The bearing surface 952 will be positioned so as to engage a wedge in the finally assembled coupling assembly, as will be described in more detail below in conjunction with FIG. 18.

Figure 17A:
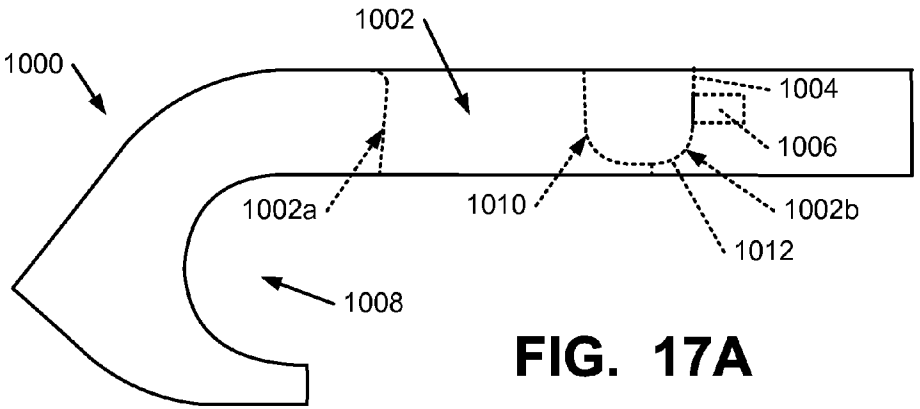
FIGS. 17A and 17B illustrate another example shroud that may be secured using coupling assemblies in accordance with another example of this invention.
Figure 17B:
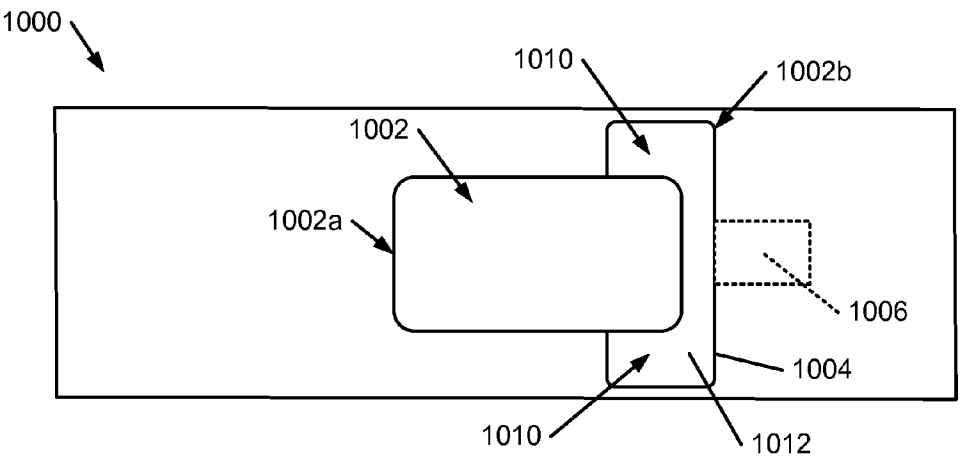

FIGS. 17A and 17B illustrate an example shroud 1000 that may be used in this example coupling assembly in accordance with the invention. This shroud 1000 is similar to shroud 106 described above in conjunction with FIGS. 2A through 2C in various ways. For example, shroud 1000 may include a similarly shaped exterior to that described above, and it may define a gap 1008 that receives the lip.

Like shrouds 106, shroud 1000 in FIGS. 17A and 17B includes an opening 1002 having a narrower portion 1002*a* and a wider portion 1002*b*. As shown in FIG. 17A, the narrower portion 1002*a* of the opening 1002 extends completely through the upper leg of the shroud 1000 whereas the wider rear portion 1002*b* extends only partially through the upper leg. In this manner, the wider portion 1002*b* provides a ledge 1012 over which the upper bearing portion 702 of a spool 700 will be located. The spool 700 of this example coupling assembly may be the same as or similar to that described above in conjunction with FIG. 12, e.g., with the top portion 702 thereof being made somewhat laterally wider than other portions of the spool 700. While the wider portion 1002*b* of the opening 1002 in this example has a generally U-shaped configuration 1010 (as seen in FIG. 17B) it could only include side portions 1002*c* to each side of the through portion 1002*a*.

FIGS. 17A and 17B further illustrate that a rear side 1004 of the opening 1002 may optionally includes one or more holes or recesses 1006 that may engage or mate with a portion of the rear of the spool 700. A piece of resilient (e.g., elastomeric) material may be received in the hole(s) or recess(es) 1006. The resilient material may be made from a block of elastomeric material, such as rubber and the like. The resilient material acts as a spring and helps keep the upper bearing portion 702 of the spool 700 pushed forward in relation to the shroud 1000 to help maintain a tighter system.

Figure 18:
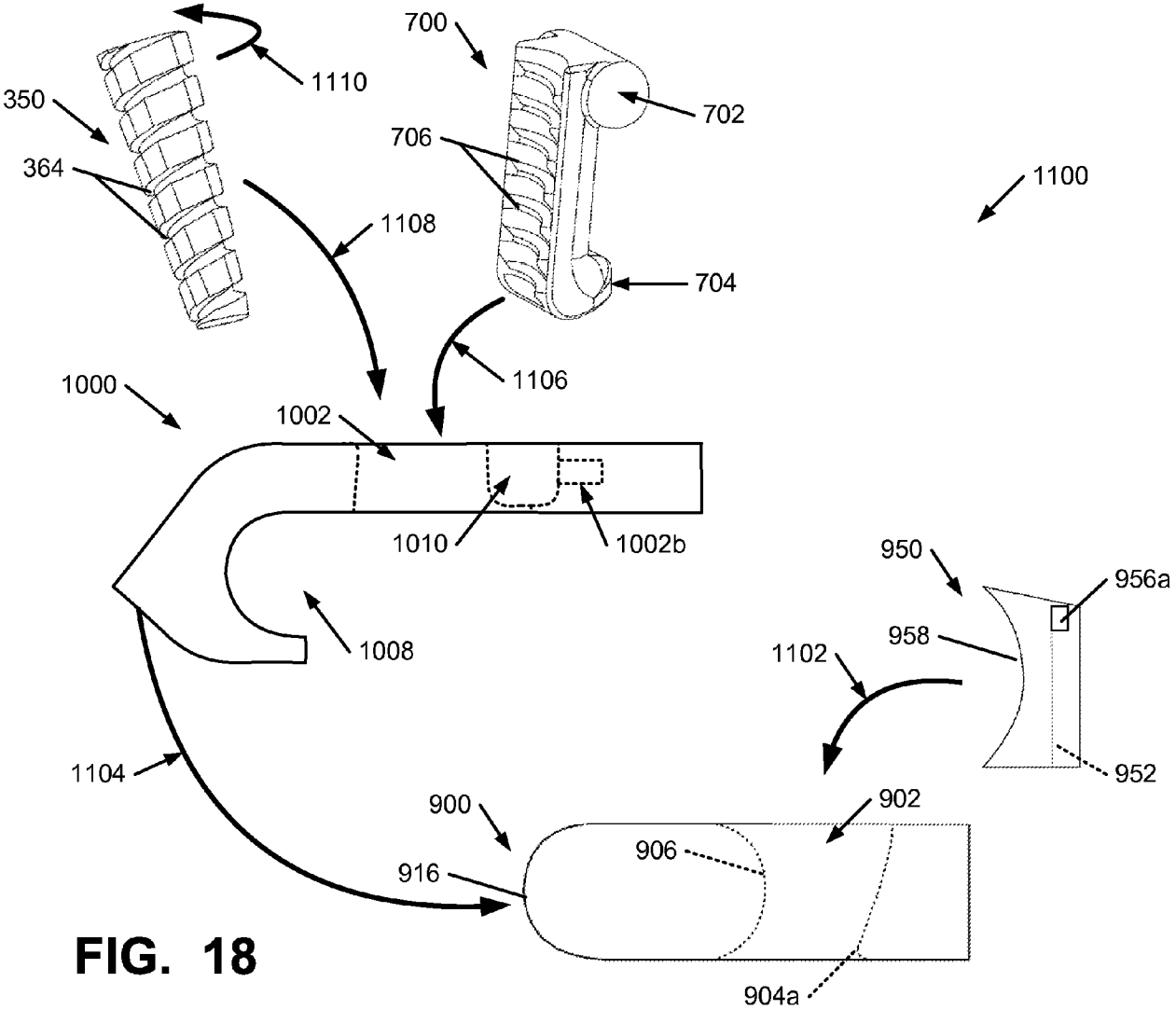
FIG. 18 is an exploded, perspective view of another alternative wear assembly in accordance with the invention using the components of FIGS. 15A through 17B.

FIG. 18 generally illustrates the steps involved in assembling the wear assembly 1100 according to this example of the invention. First, as shown by the arrow 1102 in FIG. 18, the pivoting insert 950 is slid into the opening 902 of the lip 900 so that the curved surface 958 lays adjacent side 906 and so that the curved bearing surface 952 is exposed within the opening 902. Additionally, the resilient members 956*a* and 956*b* are placed to engage the side walls 908*a* and 908*b*, respectively, of the opening 902. When mounted, the curved surface 958 of the pivoting insert 950 may be capable of moving along the curved surface 906 of the opening 902.

Then, the shroud 1000 is fit over lip 900 with insert 950 already in opening 1008 of the shroud 1000. This action is generally illustrated in FIG. 18 by arrow 1104. Once the shroud 1000 is engaged over the lip 900, the spool 700 is inserted through opening 1002 and opening 902 so that the lower bearing portion 704 engages the mounting corner 904*a* of the lip opening 902 and so that the upper mounting portion 702 is received over the ledge of shroud 1000 in side portions 1010. This step is shown in FIG. 18 by arrow 1106. At this juncture, the various parts of the coupling assembly 1100 may remain relatively loose.

At this time, the wedge 350 is inserted into the opening 1002 (shown generally in FIG. 18 by arrow 1108). Once in position, the wedge 350 is rotated (shown by arrow 1110) to engage the threads 364 of the wedge 350 with the thread segments 706 of the spool 700.

In use, as the wedge 350 is tightened and a wider portion thereof is forced into the openings 902 and 1002, the pivoting insert 950 will move with respect to the front wall 906 of the lip 900 thereby forcing rotation of the spool 950 about mounting corner 904*a*. This action forces the shroud 1000 against the lip 900 in a manner generally similar to that described above in conjunction with FIGS. 14A through 14F. Therefore, the more detailed description of this movement and take up of this example coupling assembly 1100 will be omitted.

As described above, one of the major advantages of coupling assemblies in accordance with examples of this invention relates to the large amount of take up available when these coupling systems are used. While providing relatively compact and internally contained coupling systems (i.e., the coupling assemblies may be completely or substantially internally contained within openings provided in the components to be coupled together), coupling systems in accordance with examples of this invention still facilitate large amounts of movement between the parts to be coupled (e.g., left-to-right movement of the shroud with respect to the lip in the examples described above in a range of, for example, 0.5 to 2 inches). While this feature advantageously avoids or substantially reduces the need to build up the lip as described above, it provides other advantages as well. For example, this large take up feature also allows for more manufacturing dimensional variation in manufacturing various parts of the coupling assembly and/or the openings in the parts to be coupled (i.e., the wedge can be tightened to the extent necessary to take up the gaps and securely hold the various parts together). These features also aid in the assembly and disassembly of the coupling because (a) the various parts can be relatively loosely fit together until the final tightening step is completed and (b) the various parts can be made relatively loose when the wedge is loosened so that disassembly is easy.

Also, while aspects of the present invention have been described above in connection with use of rotatable threaded wedges, this is not a requirement in all systems and methods according to this invention. Rather, if desired, at least some advantageous features of this invention may be realized when used with a conventional "driven-in" (or hammered in) wedge or a known fluted wedge. For example, if desired, a hammered wedge may be used in combination with a spool (e.g., like spool 200 or other spool structures as described above), insert (e.g., like insert 250 or other insert structures as described above), and/or resilient member (e.g., like member 302 or other resilient member structures as described above). While such a system would not be hammerless (and would lose benefits of some examples of this invention), such a locking system would still enjoy the increased take up advantages as described above. Accordingly, at least some aspects of this invention relate to use of one or more of the various locking mechanism parts described above with driven-in, pried-in, and/or fluted wedges.

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the example structures and methods described above without departing from the scope of the present invention.

We claim:

1. A wear assembly for excavating equipment comprising:

a support structure secured to the excavating equipment and including a first hole and a fulcrum;

a wear member being fit onto the support structure and including a second hole in general alignment with the first hole; and a lock including a spool and a tapered wedge inserted into the first and second holes such that the spool engages the fulcrum and the wear member, and rotates about the fulcrum when the wedge is driven into the first and second holes to push the wear member farther onto the support structure.

2. A wear assembly in accordance with claim 1 wherein the lock further includes an insert in engagement with the wedge to translate along the wedge as the wedge is driven into the first and second holes, and movable relative to the spool to increase the available take up provided by the rotation of the spool.

3. A wear assembly in accordance with claim 2 wherein the insert is received into a recess defined by the spool and moves along an arcuate surface within the recess.

4. A wear assembly in accordance with claim 3 wherein the wedge and insert are each formed with threads that are engaged together such that rotation of the wedge causes the wedge to translate along the insert.

5. A wear assembly in accordance with claim 2 wherein the insert is secured to the support structure, and the wedge is engaged by the insert and the spool on opposite sides.

6. A wear assembly in accordance with claim 1 wherein the spool includes a first bearing portion to contact the wear member, a second bearing portion to contact the fulcrum, and stem interconnecting the first and second bearing portions, and wherein the stem includes a convex front surface curved along a length of the stem to engage the wedge so that the spool rotates about the fulcrum when the wedge is driven into first and second holes.

7. A wear assembly in accordance with claim 6 wherein the wedge and spool are each formed with threads that are engaged together such that rotation of the wedge causes the wedge to translate along the spool.

8. A wear member for excavating equipment comprising a front end adapted to engage the material to be excavated, a rear end having a mounting part that overlies a support structure secured to the excavating equipment, a hole defined in the mounting part, the hole having a first portion extending through the mounting part in a first direction to receive a wedge and spool locking system to hold the wear member to the support structure, and a second portion extending only partially through the mounting part in the first direction, and the second portion having a ledge laterally outward of the first portion and extending transverse to the first direction to receive a part of the spool without urging the spool in any direction transverse to the first direction so that the ledge holds the spool in place prior to insertion of the wedge into the hole.

9. A wear member in accordance with claim 8 wherein the ledge extends laterally across the entire rear end of the hole.

10. A wear member in accordance with claim 8 wherein the ledge extends only laterally outside of the first portion of the hole.

11. A wear member in accordance with claim 8 wherein the hole includes a rear wall against which the spool pushes to tighten the fit of the wear member on the support structure when the wedge is inserted into the hole.

12. A wear member in accordance with claim 8 wherein the second portion of the hole includes a front wall to prevent forward movement of the spool to maintain a space for the insertion of the wedge into the hole.

13. A wear member in accordance with claim 8 wherein a resilient member is provided to press against the lock during use.

* * * * *